US005785120A

United States Patent [19]

Smalley et al.

[11] Patent Number: 5,785,120

[45] Date of Patent: Jul. 28, 1998

[54] TUBULAR PATCH

[75] Inventors: Michael T. Smalley, Houston; David M. Haugen, League City, both of Tex.

[73] Assignee: Weatherford/Lamb, Inc., Houston, Tex.

[21] Appl. No.: 748,987

[22] Filed: Nov. 14, 1996

[51] Int. Cl.[6] ..... E21B 29/00; E21B 29/08

[52] U.S. Cl. ..... 166/55; 166/207; 166/277

[58] Field of Search ..... 166/55, 207, 212, 166/216, 277, 387

[56] References Cited

U.S. PATENT DOCUMENTS

| | | | |
|---|---|---|---|
| 1,301,285 | 4/1919 | Leonard . | |
| 1,641,035 | 8/1927 | Hero . | |
| 1,880,218 | 10/1932 | Simmons . | |
| 1,981,525 | 11/1934 | Price . | |
| 2,214,226 | 9/1940 | English . | |
| 2,424,878 | 7/1947 | Crook . | |
| 2,519,116 | 8/1950 | Crake . | |
| 2,583,316 | 1/1952 | Bannister . | |
| 2,721,823 | 10/1955 | Hopkins et al. . | |
| 2,743,743 | 5/1956 | Galloup . | |
| 2,762,436 | 9/1956 | Brown . | |
| 2,884,066 | 4/1959 | Teplitz et al. . | |
| 2,901,044 | 8/1959 | Annold . | |
| 2,924,546 | 2/1960 | Shaw . | |
| 2,937,665 | 5/1960 | Kennedy . | |
| 2,966,173 | 12/1960 | Matherne et al. . | |
| 3,028,915 | 4/1962 | Jennings . | |
| 3,039,530 | 6/1962 | Condra . | |
| 3,162,245 | 12/1964 | Howard et al. . | |
| 3,167,122 | 1/1965 | Lang . | |
| 3,179,168 | 4/1965 | Vincent . | |
| 3,191,680 | 6/1965 | Vincent . | |
| 3,203,451 | 8/1965 | Vincent . | |
| 3,203,483 | 8/1965 | Vincent . | |
| 3,354,955 | 11/1967 | Berry . | |
| 3,489,220 | 1/1970 | Kinley . | |
| 3,669,190 | 6/1972 | Sizer et al. | 166/207 X |
| 3,691,624 | 9/1972 | Kinley | 29/523 |
| 3,712,376 | 1/1973 | Owen et al. | 166/277 |
| 3,780,562 | 12/1973 | Kinley | 72/479 |
| 3,785,193 | 1/1974 | Kinley et al. | 72/393 |
| 4,270,761 | 6/1981 | Hertz, Jr. | 277/12 |
| 4,501,327 | 2/1985 | Retz | 166/285 |
| 4,662,450 | 5/1987 | Haugen | 166/299 |
| 4,866,966 | 9/1989 | Hagen | 72/75 |
| 4,971,152 | 11/1990 | Koster et al. | 166/277 |
| 4,979,570 | 12/1990 | Mody | 166/387 |
| 5,101,908 | 4/1992 | Mody | 166/387 |
| 5,143,154 | 9/1992 | Mody et al. | 166/187 |
| 5,154,230 | 10/1992 | Dees | 166/277 |
| 5,337,823 | 8/1994 | Nobileau | 166/277 |
| 5,494,106 | 2/1996 | Gueguen et al. | 166/277 |
| 5,513,703 | 5/1996 | Mills et al. | 166/55.1 |

OTHER PUBLICATIONS

"Oilfield Services And Manufactured Products," 1984–85 Catalog, HOMCO Int'l Inc.

"Oilwell Fishing Operations: Tools and Techniques," Kemp 1990, Chapter 18.

"Fishing and Rental Tool Services, HOMCO Internal Steel Liner Casing Patch," Weatherford Enterra, 1995.

*Primary Examiner*—George A. Suchfield
*Attorney, Agent, or Firm*—Guy McClung

[57] ABSTRACT

A tubular patch system has been invented for patching operations which, in one aspect, is useful as a "through tubing" tubular patch system and has a body and a series of selectively expandable members which, once having passed through a tubular of a first diameter, are expandable in a tubular of a second diameter larger than the first diameter and then operable to expand a liner patch to seal a leak in the tubular of the second diameter. Such a system may be used in a tubular disposed within a wellbore or in a tubular on the earth surface.

20 Claims, 14 Drawing Sheets

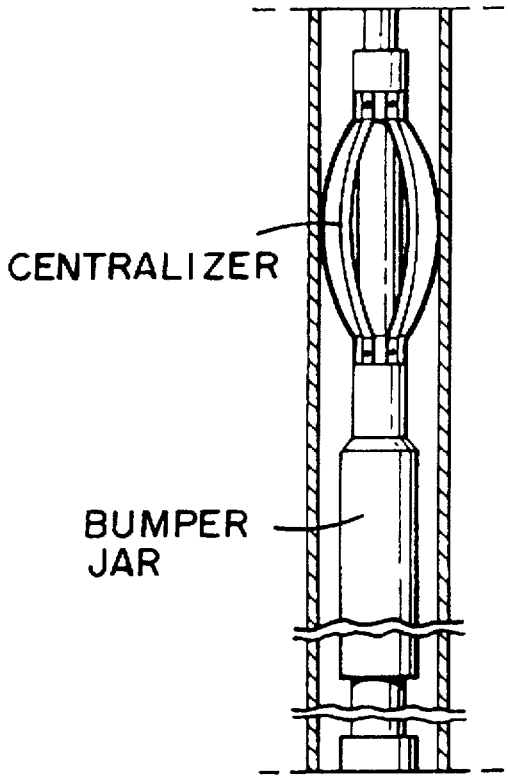
FIG. 1B
PRIOR ART
FIG. 1C
PRIOR ART
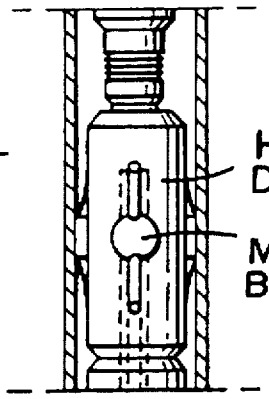

TUBULAR PATCH

BACKGROUND OF THE INVENTION

1. Field of the Invention

This invention is directed to systems for patching a hole or leak in a tubular member in a wellbore; to such systems that expand a liner patch to create a seal; and, in one particular aspect, to such a system that can be inserted through a relatively small diameter restriction as is presented by some types of tubing and then into a larger diameter member that has an area to be sealed.

2. Description of Related Art

Oil and gas wells are ordinarily completed by first cementing casing in the hole. Occasionally, a leak develops at some point in the casing and permits the loss of well fluids to a low pressure, porous zone behind the casing, or permits an unwanted fluid such as water to enter the well.

It is sometimes necessary to patch a hole or other defect in oil well pipe such as casing or production tubing by expanding a malleable liner into sealed engagement with the inside wall of the pipe.

A principal use for liners in wells is to avoid the necessity for running an entire string of smaller casing in a well which already has a larger string of casing. Possibly the most common use is in the bottom of the well where the existing casing does not extend to the bottom of the well. In this use, a short liner is lowered through the casing into the bottom of the well where a seal is formed between the liner and casing to provide a metallic liner in the well to substantially its full depth. In such cases a seal between the liner and casing is generally provided by Portland cement pumped in back of the liner to fill the space between the liner and casing. Such seals are seldom perfect. As a result, if the pressure of fluids from the formations penetrated by the well is applied to the outside of the liner and casing, a leak usually results. The liner may not be as thick or strong as the casing. When pressure is applied outside the liner and casing, the liner is compressed more than the casing and a crack forms between them even if none existed before. As soon as an opening is formed for entrance of fluids between the casing and liner, the pressures inside and outside the casing tend to become balanced, permitting the casing to return to its unstressed condition. This further widens the opening between the casing and liner. Since the wider the opening, the more the casing stress is relieved and since the more this stress is relieved, the wider the opening becomes, it is apparent that a leak between the casing and liner can hardly be avoided even though a long overlap of casing and liner is provided. This problem is particularly acute if it is desired to place a steel liner or patching steel sleeve over parted casing or a split or hole in casing. In this case, it is difficult to place Portland cement between the casing and liner and hold the cement in place until it sets. In addition, the application of pressure outside the liner quickly causes leakage in the manner just described.

Pipe such as casing or tubing for oil wells may have variations in the inside wall which reduce or enlarge the inside diameter of the pipe. If such variations are present in an area of pipe which receives a liner, it is desirable to expand the liner to conform to such variations to provide an effective seal between the liner and the pipe. A difficulty encountered in utilizing liner expanding tools in casing or production tubing is in removing the tool after the tool has been driven through the liner. If there are restrictions in the diameter of the pipe in or above the area covered by the expanded liner, there is more likelihood that the tool may hang up at the restriction and possibly even damage the liner as it is pulled therethrough.

Various devices have been devised for setting liners to patch casing, tubing, or oil well pipe. U.S. Pat. No. 3,191,677 discloses liner setting apparatus with an expander ball which is driven through the liner by an explosive jar. U.S. Pat. No. 3,489,220 discloses a method and apparatus for setting a malleable liner having a reverse bend therein over a hole in the pipe, removing a reverse bend from the liner to enlarge the diameter thereof to slightly less than the inside diameter of the pipe and expanding the liner to fit tightly in the pipe.

U.S. Pat. No. 3,785,193 discloses a tool for expanding a liner to fit tightly against the inside wall of a pipe such as oil well casing or tubing in spite of variations in the inside diameter of the pipe. The tool of this invention includes a mandrel that is adapted to be driven through the liner after the liner has been positioned over the hole or other defect in the pipe. A collet having flexible fingers extending therefrom is mounted on the mandrel and resiliently mounted pins extend from the mandrel to urge the fingers outwardly into yieldable engagement with the liner such that the liner is expanded to conform to the inside wall of a pipe. The collet may be mounted for slidable movement with respect to the laterally extending pins so that the flexible fingers can be moved inwardly as the tool is lowered into or removed from the pipe thereby preventing the fingers from damaging the liner or otherwise hanging up in the liner or pipe.

One prior art method of repairing leaks in casing includes placing a steel liner in the well, then expanding it against the inside surface of the casing. The liner is corrugated longitudinally to reduce its diameter so that it will pass through the casing easily. A thin coating of an epoxy resin or other cementing material and a glass cloth mat are applied to the outside of the liner before it is run in the well. The corrugated liner is run in the well on a tubing string, then expanded against the casing by drawing an expander device through the liner with the upper end of the liner resting against the lower end of the tubing. The expander device is moved through the liner by a hydraulic pump, operated by fluid supplied through the tubing. This method of placing the liner sometimes presents problems which contribute significantly to the expense of the operation. One problem is that the tubing string must be pulled and run in the well twice, once to attach the sleeve and setting tool and once to remove the setting tool. Another problem is that weak sections in the tubing sometimes fail under the force of the hydraulic pressure used to operate the expander.

U.S. Pat. No. 3,167,122 discloses a method and apparatus for expanding a steel liner in a casing using wire line equipment after the tubing has been removed from the well, thereby reducing the amount of time necessary to place the liner and avoiding the risk or rupturing the tubing with hydraulic pressure. The corrugated liner is supported on a rod attached to the wire line or cable with the rod passing through the longitudinal axis of the liner and the expander device attached to the rod below the liner. An explosive charge inside the liner is detonated when the liner is opposite the leak in the casing to expand the liner against the casing with sufficient force to anchor the liner so that the expander can be pulled through to complete the expansion of the liner.

FIGS. 1A–1I show a prior art casing patch system co-owned with the present invention. As shown in FIGS. 1A and 1I, the prior art system includes an upper connection for connection to a tubular string above the system (e.g. to a tubing string or coiled tubing) a centralizer, a slide valve, a bumper jar, an anchoring hydraulic hold down, a setting tool including dual hydraulic cylinders (each cylinder has a movable piston therein), extending rods (extending from a polish rod connected to a piston in one of the dual hydraulic cylinders to any extending rod which itself is connected to a safety joint), and an expander assembly that includes a safety joint, a cone, and a collet assembly, and a lower plug or end, e.g. a bull plug. The liner may be a steel liner and is initially located over the polish rod.

As shown in FIG. 1A, the liner has been coated with epoxy resin and the system has been run into casing in a cased wellbore on a working string (e.g. a tubular string or coiled tubing). The liner is positioned adjacent a leak area ("Leak").

As shown in FIG. 1B the working string is raised to close the circulating slide valve. FIG. 1C illustrates the application of hydraulic pressure (e.g. provided by an hydraulic fluid pumping system at the surface which pumps fluid down the working string and to the prior art patch system) which forces out movable buttons on the hydraulic hold down anchoring the system at the desired location in the casing and isolating the working string from tensile loads associated with the setting operation.

As shown in FIG. 1D, hydraulic fluid pressure on the underside of the piston (arrow pointing up) pulls the expander assembly into the bottom of the corrugated liner patch. As pressure increases the expander assembly is forced further into the patch (upwardly) expanding it against the inside of the casing. About four and a half feet of the corrugated liner patch are expanded in one stroke of the setting tool. Then the circulating valve is opened by lowering the working string and telescoping the valve. The working string is raised again to pull up the dual cylinders of the setting tool in relation to pistons held down by the expander assembly. An expanded section of the patch is anchored to the casing wall by friction caused by compressive hoop stress. Hydraulic pressure is again applied to tubing after closing the circulating valve. Hydraulic hold down buttons expanded to anchor the cylinder in a new, higher position.

As shown in FIG. 1E, the expander assembly is again forced through the corrugated patch, expanding it against the inside of casing. This procedure is continued until the entire patch is set. The epoxy resin coating is extruded into leaks or cavities in the casing wall and acts as a gasket and additional sealing agent. Setting time normally requires less than thirty minutes for a twenty foot patch. The tool is then removed from the hole and the patch is pressure tested as required.

A system as shown in FIG. 1A permits limited expansion and contraction of its collet assembly and is not suitable as a "thru-tubing" system or a system to be run through a first relatively small tubular into a relatively larger tubular to be repaired.

There has long been a need for a casing patch system which is efficient and effective. There has long been a need for such a system which is insertable through a smaller diameter restriction, tubular, or tubular string into a larger diameter tubular, e.g. casing, which has a leak or hole to be repaired. There has long been a need for such a system that is easily releasable and retrievable, particularly in the event of sticking within a liner patch. There has long been a need for such a system that effectively irons out substantially all of a liner patch. There has long been a need for such a system that prevents premature entry of a top cone into a liner to be expanded prior to full extension of an liner expander apparatus.

SUMMARY OF THE PRESENT INVENTION

The present invention, in certain embodiments discloses a tubular patch repair system which is insertable through a first tubular or tubular string (e.g. tubing, casing) and then is movable into a second tubular or tubular string whose inside diameter is larger than that of the first tubular or tubular string to repair a hole or leak in the second tubular or tubular string. In one aspect such a system has at least one set of collet fingers each with an end movably secured to a housing and movable with resepct to a collet expander in response to fluid under pressure introduced into the system from the surface through a working string to push the collet fingers out from the body once the system is positioned beneath a liner to be expanded in the second tubular or tubular string. Pulling the expanded collet fingers and associated structure through the liner expands the liner to patch a hole in the second tubular.

The system may ahve a sleeve shear pinned at the top of the body so that a top nose cone does not prematurely enter the liner. The pins are sheared following correct deployment of the collet fingers by pulling on the system.

In one aspect two sets of collet fingers are used which encircle a housing to which one end thereof is secured and encircle the expander with respect to which the other ends thereof are movable. The two sets are opposed to each other and, in certain aspects, have ends that meet and are offset radially to present a smooth overall expansion surface to a liner to be expanded.

In one aspect a system according to this invention has expandable collet fingers that contract when they exit the top of a liner that has been expanded. This occurs when fluid under pressure is no longer applied to the system so that internal spring(s) urge the fingers back to an initial non-expanded position.

In one aspect an expander system is disclosed for passage through a liner patch to expand the liner patch to seal a hole in a tubular member, the tubular member part of a tubular string in a wellbore extending from a surface of the earth down into the earth, the expander system having a body having a top, a bottom, and a middle portion, the top having an outer diameter, the bottom having an outer diameter substantially equal to the outer diameter of the top, and the middle portion having an outer diameter greater than the outer diameter of the top, a first set of first fingers, each first finger movable and having a first finger top and a first finger bottom, the first finger bottoms disposed around the top of the body and releasably connected thereto, a second set of second fingers (either set optional), each second finger movable and having a second finger top and bottom, the tops disposed around the bottom of the body and releasably connected thereto, movement apparatus for releasing the sets of fingers and moving them to abut the middle portion so that they project radially outwardly from the middle portion; such an expander system wherein each first finger has an inwardly directed male detent, the top of the body has a female recess corresponding to each male detent of a first finger, the middle portion of the body has a female recess corresponding to each male detent of a first finger, the male detents of the first fingers initially releasably held in the corresponding female recesses of the top of the body; either such expander system with the first fingers movable outwardly by the movement apparatus to move the male detents of the first fingers out from the corresponding female recesses in the top of the body, and the first fingers then movable by the movement apparatus to move each male detent into a corresponding female recess on the middle portion of the body; any such expander system wherein each second finger has an inwardly directed male detent, the top of the body has a female recess corresponding to each male detent of a second finger, the middle portion of the body has a female recess corresponding to each male detent of a second finger, the male detents of the second fingers initially releasably held in the corresponding female recesses of the top of the body; any such expander system with the second fingers movable outwardly by the movement apparatus to move the male detents of the second fingers out from the corresponding female recesses in the top of the body, and the second fingers then movable by the movement apparatus to move each male detent into a corresponding female recess on the middle portion of the body; any such expander system wherein each first finger bottom has a recess therein and each second finger top is shaped for receipt within an opposing first finger bottom, and the expander system with the fingers movable by the movement apparatus so that at least a portion of each second finger top is movable into at least a portion of a corresponding opposing recess in an opposing first finger bottom; any such expander system wherein the first fingers are circumferentially offset with respect to the second fingers; any such expander system with a housing having a top and having a bottom to which the first finger tops are secured, a nose cone secured to the top of the housing, the nose cone for facilitating entry of the expander system into the liner patch, a nose cone sleeve disposed about the nose cone for initially abutting a lower end of the liner patch to prevent entry of the nose cone into the liner patch, the nose cone sleeve releasably secured to the top of the housing by a shearable member which is selectively shearable by imposing a force on the housing sufficient to shear the shearable member thereby permitting entry of the nose cone into the liner patch; any such expander system with a connecting rod movably extending through the nose cone and through the housing, the connecting rod connected to a working string extending through the wellbore to the earth surface, and a piston movably disposed within the housing and connected to the connecting rod so that pulling up on the connecting rod moves the piston to the top of the housing and then pulling up on the connecting rod with the working string applies force to shear the shearable member; any such expander system with at least one adjusting member releasably secured to the body, the fingers movable over the at least one adjusting member so that the fingers project radially outward from the adjusting member for expanding the liner patch; any such expander system with a plurality of adjusting members, one of the plurality of adjusting members releasably attached to each first finger bottom so that a portion of the adjusting members projects radially outward from the first finger bottoms; any such expander system with a plurality of adjusting members, one of the plurality of adjusting members releasably attached to each second finger top so that a portion of the adjusting members projects radially outward from the second finger tops; any such expander system with a plurality of adjusting members, one of the plurality of adjusting members releasably attached to alternating first finger bottoms and one of the plurality of adjusting members attached to alternating second finger tops, a portion of the adjusting members projecting radially outward from the fingers; any such expander system wherein the outer diameter of the middle portion is at least one inch greater than the outer diameter of the top of the body; any such expander system with reset apparatus contacting the body for automatically moving the fingers away from the middle portion of the body upon exit of the expander system from the liner patch, and, in on aspect, wherein the reset apparatus has a first housing having a top, a bottom and bore therethrough from top to bottom, the first finger tops secured to the bottom of the first housing, an upper spring seat disposed across the bore of the first housing driving the first housing into an upper chamber and a lower chamber, a first spring in the lower chamber which urges the first housing away from the body, the first spring having a spring force which must be overcome by the movement apparatus to release the first fingers from the body; any such expander system with a hollow connecting rod extending through the body, the connecting rod having a fluid flow channel therethrough, a lower housing to which the second finger bottoms are secured and through which extends and to which is secured to a lower end of the connecting rod, an upper housing to which the first finger tops are secured and through which movably extends a portion of the connecting rod, a shearable member releasably holding the connecting rod and initially preventing the connecting rod from moving with respect to the body, the connecting rod connected to a working string extending up to the earth surface through the wellbore, a piston cylinder disposed above the body, a portion of the connecting rod extending through the piston cylinder, a piston connected to the connecting rod and movable on said rod in the piston cylinder, the piston cylinder disposed so that fluid under pressure is selectively flowable thereinto to shear the shearable member forcing the upper and lower housings away from the body moving the fingers away from the middle portion of the body.

In one aspect the present invention discloses an expander system for passage through a liner patch to expand the liner patch to seal a hole in a tubular member, the tubular member part of a tubular string in a wellbore extending from a surface of the earth down into the earth, the expander system having a body having a top, a bottom, and a middle portion, the top having an outer diameter, the bottom having an outer diameter substantially equal to the outer diameter of the top, and the middle portion having an outer diameter greater than the outer diameter of the top, a first set of first fingers, each first finger movable and having a first finger top and a first finger bottom, the first finger bottoms disposed around the top of the body and releasably connected thereto, a second set of second fingers, each second finger movable and having a second finger top and a second finger bottom, the second finger tops disposed around the bottom of the body and releasably connected thereto, movement apparatus for releasing the first and second sets of fingers from the body and moving the fingers to abut the middle portion of the body so that the fingers project radially outwardly from the middle portion of the body, each first finger having an inwardly directed male detent, the top of the body having a female recess corresponding to each male detent of a first finger, the middle portion of the body having a female recess corresponding to each male detent of a first finger, the male detents of the first fingers initially releasably held in the corresponding female recesses of the top of the body, the first fingers movable outwardly by the movement apparatus to move the male detents of the first fingers out from the corresponding female recesses in the top of the body, and the first fingers then movable by the movement apparatus to move each male detent into a corresponding female recess on the middle portion of the body, each second finger having an inwardly directed male detent, the top of the body having a female recess corresponding to each male detent of a second finger, the middle portion of the body having a female recess corresponding to each male detent of a second finger, the male detents of the second fingers initially releasably held in the corresponding female recesses of the top of the body, the second fingers movable outwardly by the movement apparatus to move the male detents of the second fingers out from the corresponding female recesses in the top of the body, and the second fingers then movable by the movement apparatus to move each male detent into a corresponding female recess on the middle portion of the body, each first finger bottom having a recess therein and each second finger top shaped for receipt within an opposing first finger bottom, the expander system further comprising the fingers movable by the movement apparatus so that at least a portion of each second finger top is movable into at least a portion of a corresponding opposing recess in an opposing first finger bottom, and the first fingers circumferentially offset with respect to the second fingers. In certain embodiments the present invention discloses an expander system for passage through a liner patch to expand the liner patch to seal a hole in a tubular member, the tubular member part of a tubular string in a wellbore extending from a surface of the earth down into the earth, the expander system having a body having a top, a bottom, and a middle portion, the top having an outer diameter, the bottom having an outer diameter substantially equal to the outer diameter of the top, and the middle portion having an outer diameter greater than the outer diameter of the top, a first set of first fingers, each first finger movable and having a first finger top and a first finger bottom, the first finger bottoms disposed around the top of the body and releasably connected thereto, a second set of second fingers, each second finger movable and having a second finger top and a second finger bottom, the second finger tops disposed around the bottom of the body and releasably connected thereto, movement apparatus for releasing the first and second sets of fingers from the body and moving the fingers to abut the middle portion of the body so that the fingers project radially outwardly from the middle portion of the body, a housing having a top and having a bottom to which the first finger tops are secured, a nose cone secured to the top of the housing, the nose cone for facilitating entry of the expander system into the liner patch, a nose cone sleeve disposed about the nose cone for initially abutting a lower end of the liner patch to prevent entry of the nose cone into the liner patch, the nose cone sleeve releasably secured to the top of the housing by a shearable member which is selectively shearable by imposing a force on the housing sufficient to shear the shearable member thereby permitting entry of the nose cone into the liner patch, a connecting rod movably extending through the nose cone and through the housing, the connecting rod connected to a working string extending through the wellbore to the earth surface, a piston movably disposed within the housing and connected to the connecting rod so that pulling up on the connecting rod with the working string moves the piston to the top of the housing and then pulling up on the connecting rod with the working string applies force to shear the shearable member, and reset apparatus contacting the body for automatically moving the fingers away from the middle portion of the body upon exit of the expander system from the liner patch.

In one aspect the present invention discloses an expander system for passage through a liner patch to expand the liner patch to seal a hole in a tubular member, the tubular member part of a tubular string in a wellbore extending from a surface of the earth down into the earth, the expander system having a body having a top, a bottom, and a middle portion, the top having an outer diameter, the bottom having an outer diameter substantially equal to the outer diameter of the top, and the middle portion having an outer diameter greater than the outer diameter of the top, a first set of first fingers, each first finger movable and having a first finger top and a first finger bottom, the first finger bottoms disposed around the top of the body and releasably connected thereto, a second set of second fingers, each second finger movable and having a second finger top and a second finger bottom, the second finger tops disposed around the bottom of the body and releasably connected thereto, movement apparatus for releasing the first and second sets of fingers from the body and moving the fingers to abut the middle portion of the body so that the fingers project radially outwardly from the middle portion of the body, each first finger having an inwardly directed male detent, the top of the body having a female recess corresponding to each male detent of a first finger, the middle portion of the body having a female recess corresponding to each male detent of a first finger, the male detents of the first fingers initially releasably held in the corresponding female recesses of the top of the body, the first fingers movable outwardly by the movement apparatus to move the male detents of the first fingers out from the corresponding female recesses in the top of the body, and the first fingers then movable by the movement apparatus to move each male detent into a corresponding female recess on the middle portion of the body, each second finger having an inwardly directed male detent, the top of the body having a female recess corresponding to each male detent of a second finger, the middle portion of the body having a female recess corresponding to each male detent of a second finger, the male detents of the second fingers initially releasably held in the corresponding female recesses of the top of the body, the second fingers movable outwardly by the movement apparatus to move the male detents of the second fingers out from the corresponding female recesses in the top of the body, and the second fingers then movable by the movement apparatus to move each male detent into a corresponding female recess on the middle portion of the body, each first finger bottom having a recess therein and each second finger top shaped for receipt within an opposing first finger bottom, and the expander system further comprising the fingers movable by the movement apparatus so that at least a portion of each second finger top is movable into at least a portion of a corresponding opposing recess in an opposing first finger bottom, the first fingers circumferentially offset with respect to the second fingers, a plurality of adjusting members, one of the plurality of adjusting members releasably attached to each first finger bottom so that a portion of the adjusting members projects radially outward from the first finger bottoms, and a plurality of adjusting members, one of the plurality of adjusting members releasably attached to each first finger bottom so that a portion of the adjusting members projects radially outward from the first finger bottoms.

It is, therefore, an object of at least certain preferred embodiments of the present invention to provide:

New, useful, unique, efficient, nonobvious systems and methods for patching a hole or leaking area in a tubular member at the surface or in a tubular string in a wellbore into the earth;

Such a system which can be used "thru tubing;"

Such a system which prevents premature cone entry into a liner to be expanded; and Such a system with liner expanders that automatically contract upon exiting an expanded liner.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1B is a side view in cross-section and cutaway of part of the system of FIG. 1A.

FIGS. 1C–1E show steps in the operations of the system of FIG. 1A.

FIG. 1I is an exploded view showing various parts of the system of FIG. 1A.

DESCRIPTION OF EMBODIMENTS PREFERRED AT THE TIME OF FILING FOR THIS PATENT

Figure 1A:
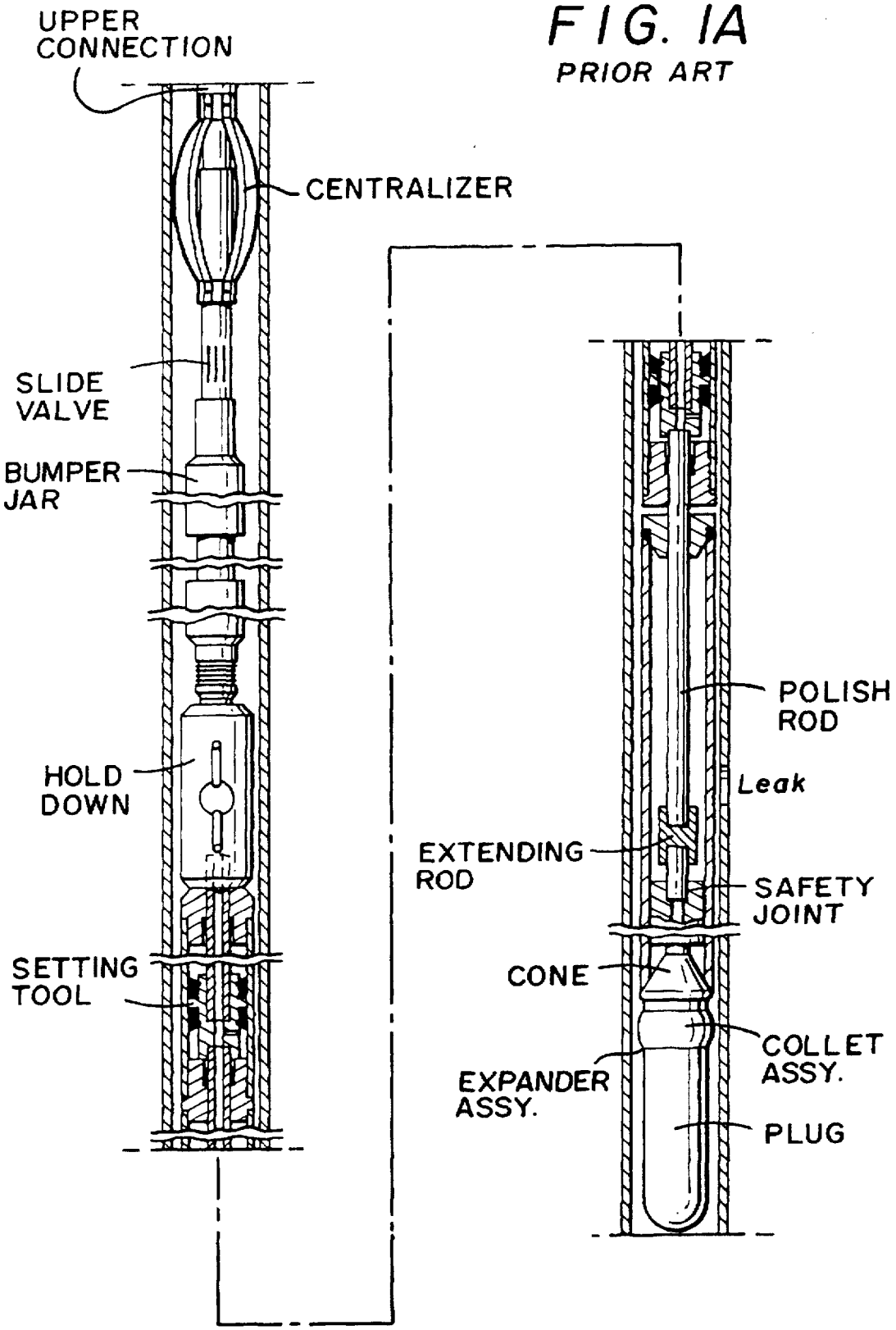
FIG. 1A PRIOR ART
FIG. 1A is a side view in cross-section and cutaway of a prior art casing patch system.
Figure 1D:
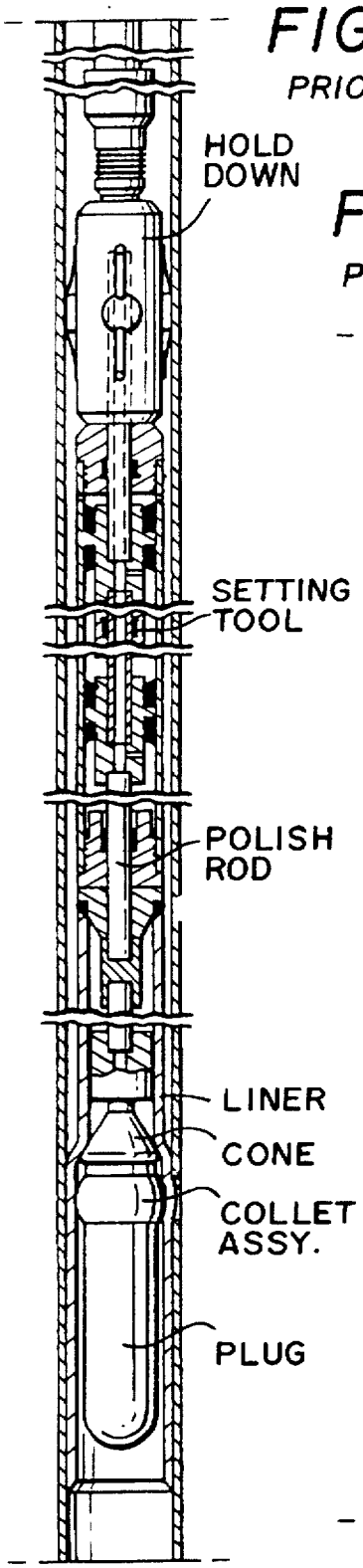
FIG. 1D PRIOR ART
Figure 1E:
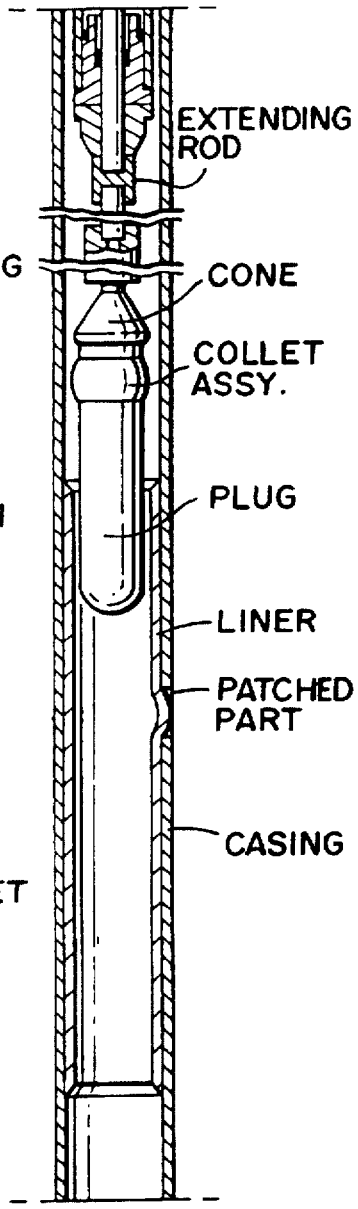
FIG. 1E PRIOR ART
Figure 1F:
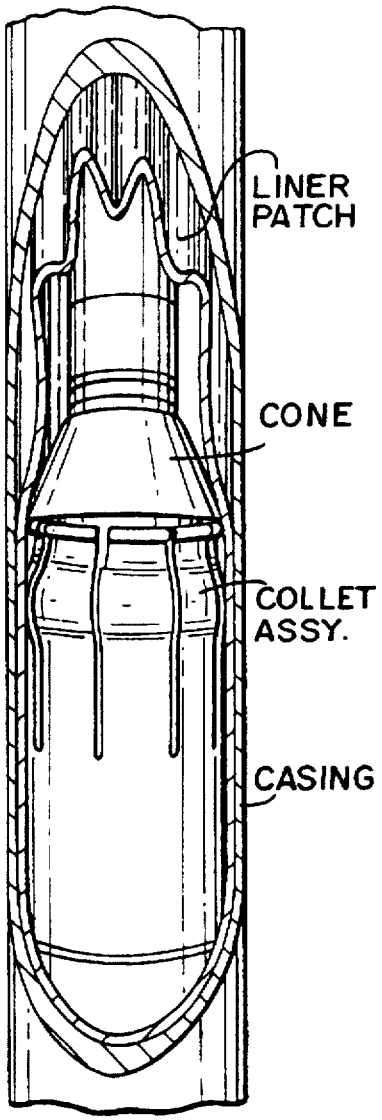
FIG. 1F PRIOR ART
FIG. 1F is a side cutaway view showing the use of the system of FIG. 1A.
Figure 1G:
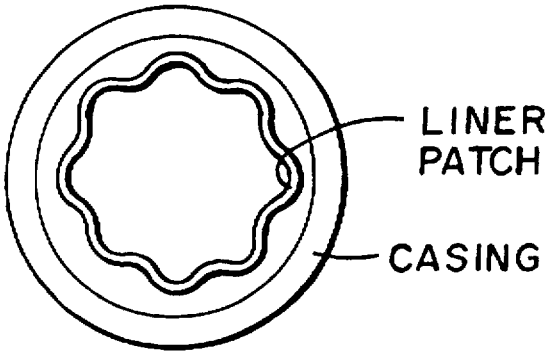
FIG. 1G PRIOR ART
FIG. 1G shows a liner patch in a casing prior to liner patch expansion.
Figure 1H:
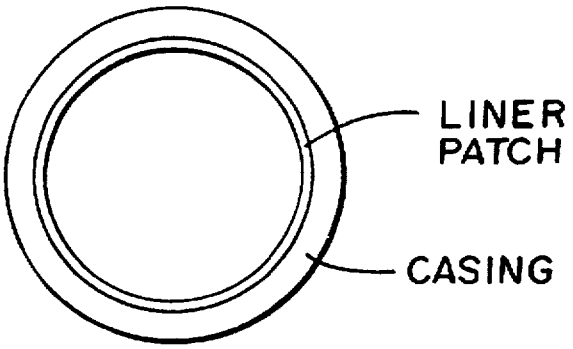
FIG. 1H PRIOR ART
FIG. 1H shows the liner patch of FIG. 1G expanded in the casing.
Figure 11:
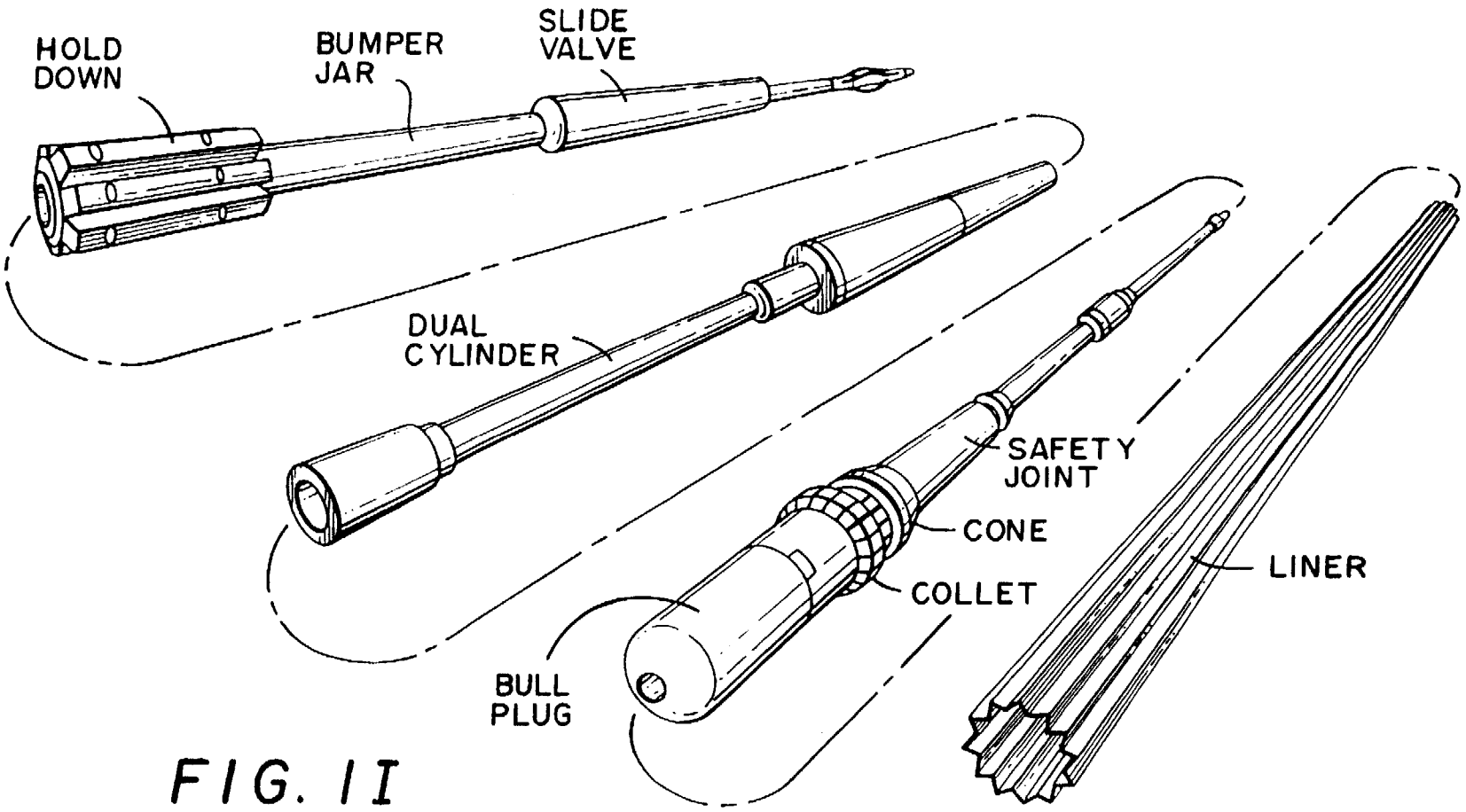
FIG. 11 PRIOR ART
Figure 2A:
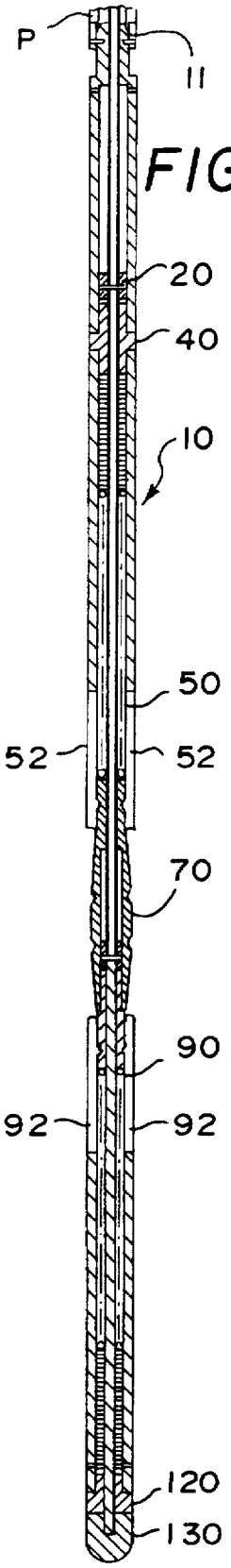
FIGS. 2A–2C are side cross-section views of a patch system according to the present invention.

FIGS. 2A shows a system 10 according to the present positioned beneath a liner casing patch P in a cased wellbore (not shown, like the casing in FIG. 1A) prior to movement of the system 10 through the liner patch P. The system 10 may include (and does in this particular aspect) the items and apparatuses above the cone of the system of FIG. 1A and the description of them is repeated here.

Figure 2B:
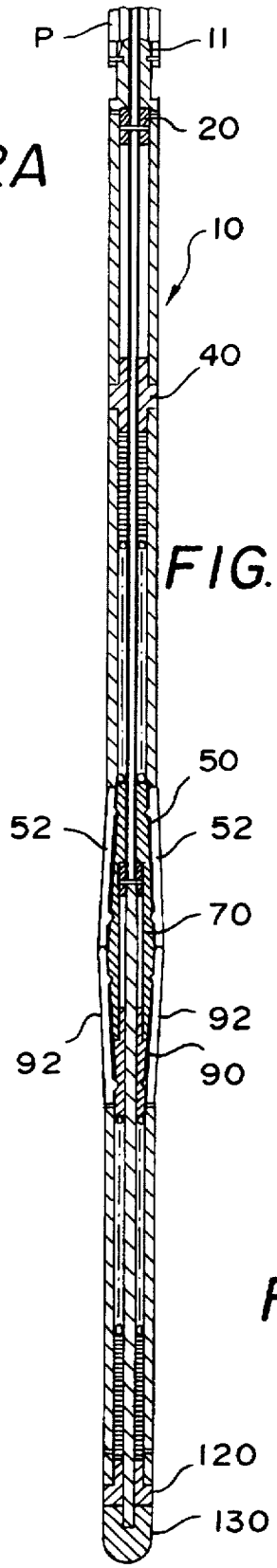
Figure 2C:
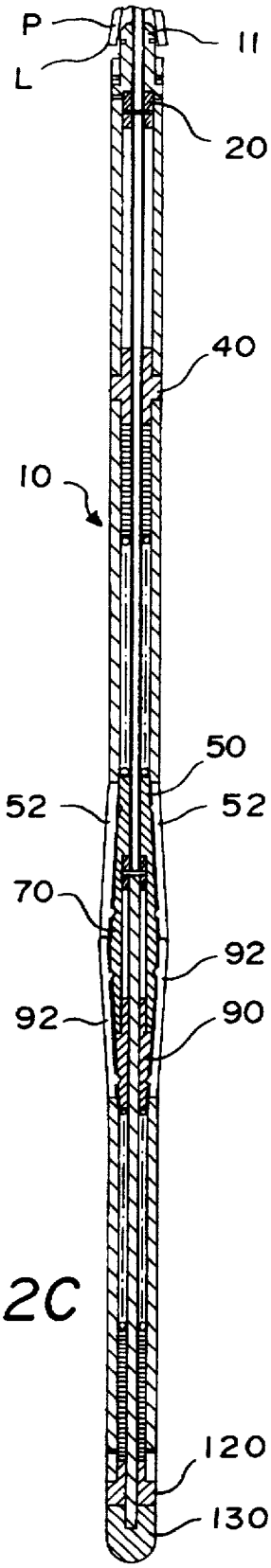

FIG. 2B shows the system 10 with collet fingers 52 and 92 moved and held outwardly. FIG. 2C shows the cone 11 after it has begun its entry into the liner patch P.

Figure 3A:
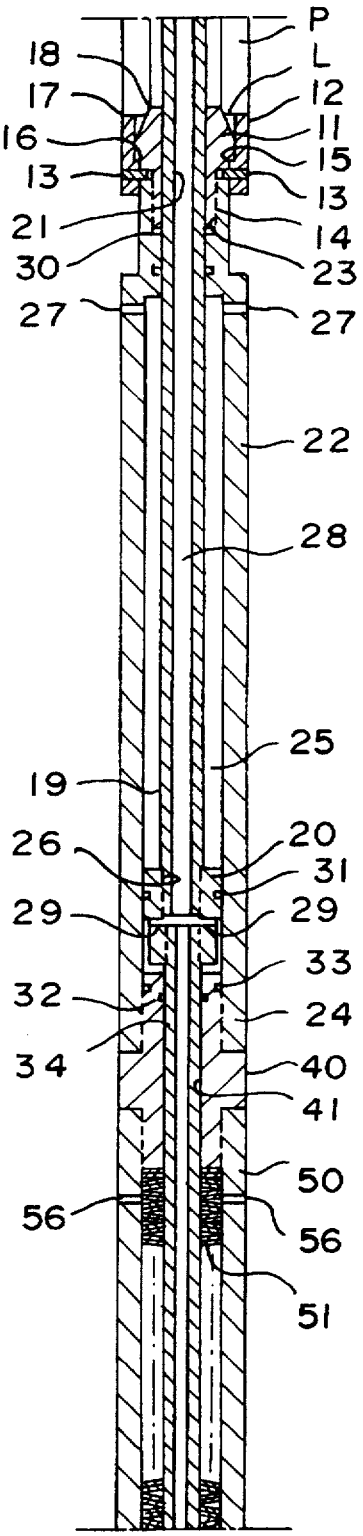
FIGS. 3A–3E, 4A, 4B and 5 are enlarged views of parts of the system of FIG. 2A.

FIG. 3A shows parts of the system 10 according to the present invention as shown in FIG. 2A. The system 10 has a cone 11 initially disposed in a sleeve 12 which itself is shear pinned with three shear pins 13 (two shown) to a piston housing 22. The cone 11 has a shaft 14 threadedly engaged in a recess 23 of the piston housing 22. A shoulder 15 of the cone 11 rests initially against a shoulder 16 of the sleeve 12. An upper end 17 of the sleeve 12 is sized, disposed and configured to abut a lower end L of a liner patch P (shown partially in FIGS. 2A and 3A) so that a tapered end portion 18 of the cone 11 either initially touches or is closely adjacent the lower end L of the liner patch P. Initially the sleeve 12 prevents the cone 11 from entering the liner patch P.

A lower end 24 of the piston housing 22 is threadedly connected to an upper spring seat 40. An upper piston 20 is movably disposed in an interior piston channel 25 of the piston housing 22. A lower end of a connecting rod 19 is threadedly connected in a top recess 26 of the upper piston 20. A top end (not shown) of the connecting rod 19 is connected to a hollow extension rod (not shown) (like the extending rod of FIG. 1A, but with a fluid flow channel therethrough) (like the hollow rod W, FIG. 6B). The connecting rod 19 is movable in the interior piston channel 25 and through an interior channel 21 of the cone 11.

In subsequent operations fluid in the interior piston channel 25 is expelled through two relief ports 27 through the piston housing 22. Fluid (e.g. working fluid pumped from the surface by a surface pumping unit through a string interconnected with the connecting rod 19) under pressure (e.g. water, mud, drilling fluid, hydraulic fluid) flows through the string (e.g. tubular string, coiled tubing string, etc.), through an interior channel 28 of the connecting rod 19, out through two ports 29 and into a sealed space below the upper piston 20 in the interior piston channel 25.

An O-ring seal 30 seals the connecting-rod-19-piston-housing-22 interface. A T-seal 31 (made e.g. of elastomeric or rubber material, e.g. commercially available Viton material) seals the upper-piston-20-piston-housing-22 interface. A T-seal 32 seals the upper-spring-seat-40-connecting-rod-34 interface. An O-ring seal 33 seals the piston-housing-22-upper spring seat 40 interface.

Figure 3B:
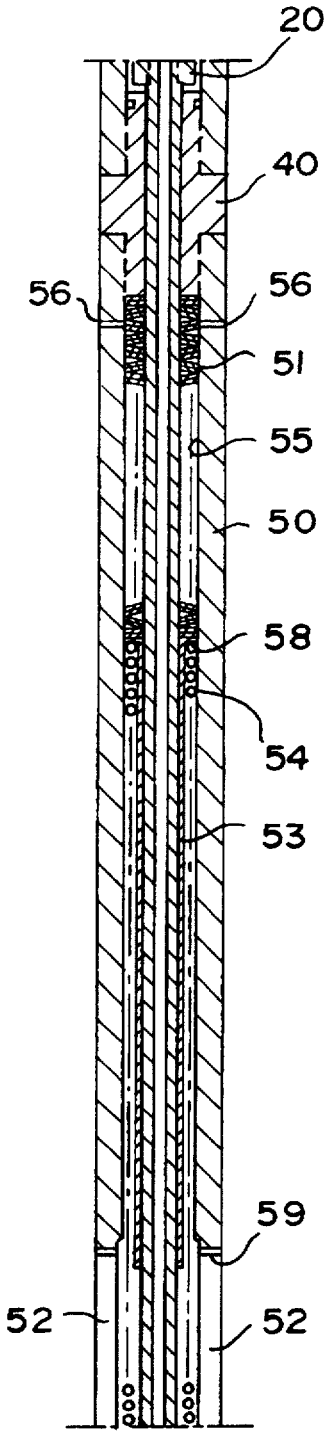
Figure 3C:
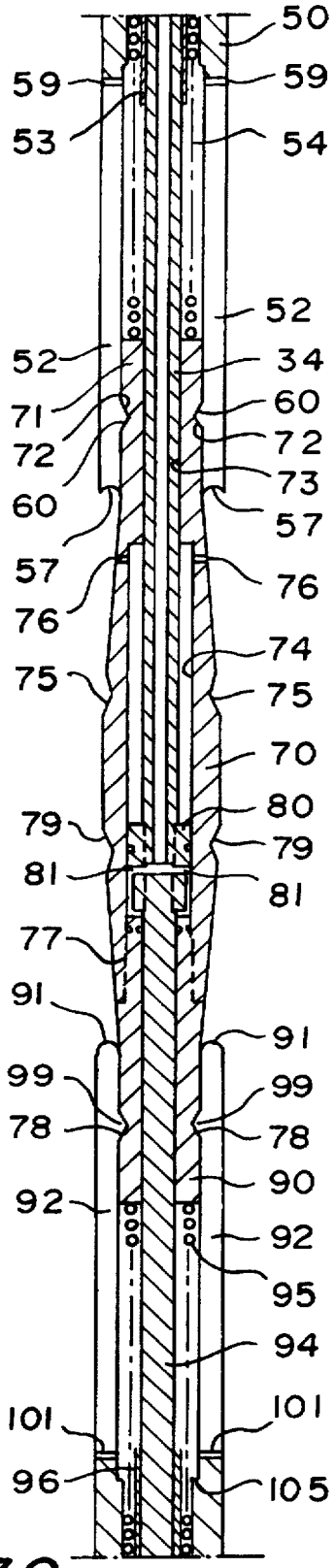
Figure 3D:
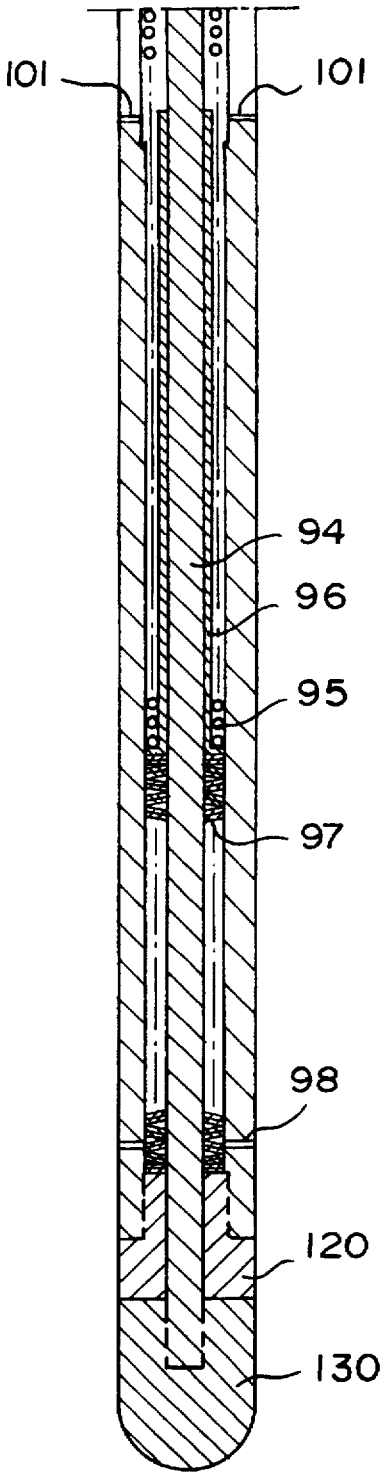

The upper piston rod 34 moves within an interior channel 41 of the upper spring seat 40; within a set of belleville springs 51 positioned in an upper collet 50; within a spring sleeve 53 in the upper collet 50; within a coil spring 54; and within a collet expander 70 (see FIGS. 3A, 3B, and 3C).

A lower end 42 of the spring seat 40 is threadedly connected to an upper end of the upper collet 50. The belleville springs 51 are disposed in an interior channel 55 of the upper collet 50 with a top end of the springs 51 abutting the lower surface of the upper spring seal 40. Fluid relief ports 56 provide for the expulsion of fluid from within the interior channel 55.

Figure 3E:
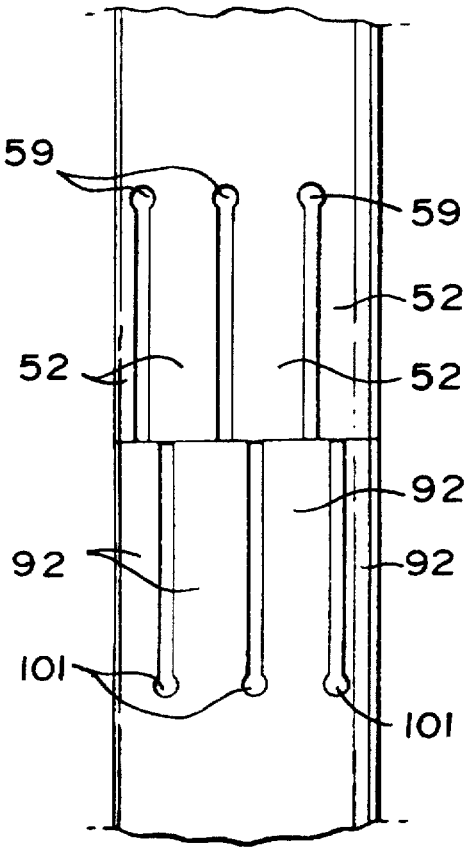

The lower end of the belleville springs 51 abut a top surface of a flange 58 of the spring sleeve 53. A top end of the coil spring 54 abuts a lower surface of the flange 58 and a bottom end of the coil spring 54 abuts a top end 71 of the collet expander 70. A series of expandable fingers 52 are formed around the lower end of the upper collet 50, each with a lower recess 57 and with stress relief holes 59 therebetween (see FIG. 3E). Also each finger 52 has a male detent 60 initially receivable and holdable in a corresponding female recess 72 of the collet expander 70. In one particular embodiment the fingers 52 are about fourteen inches long with a space of about one-eighth inch between adjacent fingers and as shown in FIG. 3E with ends of fingers 52 offset from ends of fingers 92. About three thousand pounds of force is required to move such fingers out of their corresponding female recesses. In such an embodiment the belleville springs 51 have a spring force between about one thousand four hundred to about seven thousand pounds and, in one particular aspect, about four thousand pounds; and the coil spring 54 has a spring force between about seven hundred pounds to about two thousand five hundred pounds and, in one particular aspect, about one thousand five hundred pounds. In such an embodiment a force of about seven hundred and fifty pounds must be continuously applied to move the collet fingers along the outer edge of the collet expander 70 and a force of about four thousand pounds is needed to move the made detents 60 out from the corresponding female recesses 72. Bottoming out (e.g. lower end abuts top of collet expander) of the spring sleeve 53 isolates the coil spring 54 and permits a load to be transmitted to the belleville springs 51 so that sufficient force can be applied to move the fingers along the collet expander.

The collet expander 70 is generally cylindrical with a top inner channel 73 in the top end 71 in which the upper piston rod 34 moves and with a central channel 74 in which the upper piston rod 34 moves and in which moves a lower piston 80 to which a lower end of the upper piston rod 34 is threadedly connected. Each male detent 60 of the fingers 52 is movable into a female recess 75 on the collet expander 70. Fluid relief ports 76 provide for the expulsion of fluid from within the collet expander 70.

Working fluid from the surface is flowable down through the upper piston rod 34 and out through ports 81 in the lower piston 80 into a space in the central channel 74 between the lower piston 80 and a top end 77 of a lower collet expander body (with some space between the lower piston 80 and the interior surface of the central channel 74). These structures are sealed similarly to those related to the upper spring seat.

Fingers 92 of the lower collet 90 have male detents 99 which are initially held in corresponding female recesses 78 of the lower collet expander body 77. Top curved surfaces 91 of the fingers 92 correspond to the recesses 57 of the fingers 52 and are receivable therein.

The upper and lower ends of the collet expander 70 and its central portion are sized and configured to provide a desired amount of radial expansion of the fingers 52 and 92 which completely encircle the collet expander. In certain preferred embodiments (e.g. the specific embodiment above in which belleville springs have a spring force of about four thousand pounds) the initial maximum diameter of the system 10 (e.g. the diameter at the initial location of the fingers 52 or 92 in FIG. 3A) is slightly less than 4.4 inches and the expanded diameter (with the fingers 52, 92 having moved so their male detents are in the female recesses 75 and 79, respectively) is slightly less than 5.921 inches. In other embodiments expansion is about one, one and a half, two, three, six, twelve, twenty or thirty inches.

A lower piston rod 94 has a top end threadedly connected to the lower piston 80 and a bottom end threadedly connected to a bull plug 130. The lower piston rod 94 movably extends through the lower collet expander body 77; through a coil spring 95 in the lower collet 90; through a spring sleeve 96 within the coil spring 95; through a set of belleville springs 97; and through a lower spring seat 120. The coil spring 95, like the previously described coil spring 54, may be like the specific embodiments of the coil spring 54 described above. The belleville springs 97 are like the described belleville springs 51; and certain specific embodiments thereof are like embodiments of the belleville springs 51 described above.

Fluid relief ports 98 provide for the expulsion of fluid from within the lower collet 90. An inner shoulder 105 of the lower collet 90 is movable to abut the lower end of the lower collet expander body 77 thereby arresting motion of the lower collet with respect to the collet expander 70. The fingers 92 are formed and configured as the fingers 52, described above, with holes 101 therebetween.

Figure 4A:
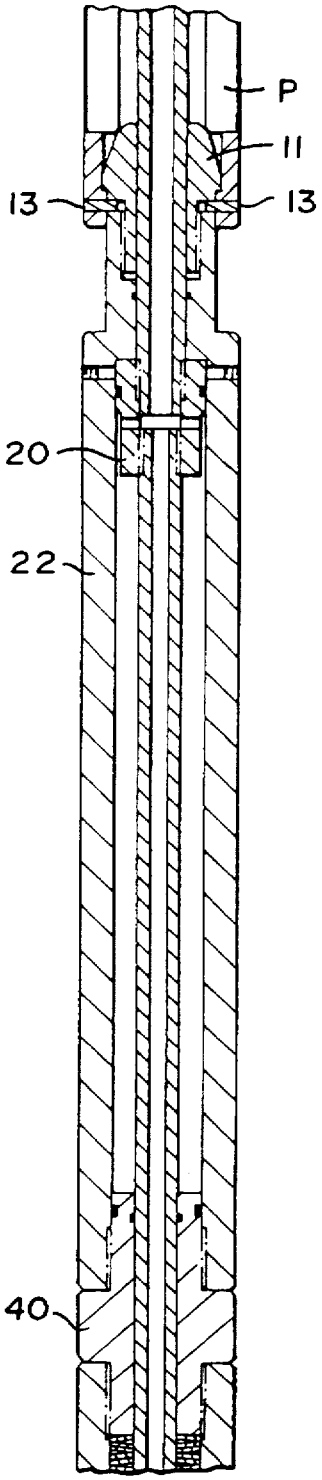
Figure 4B:
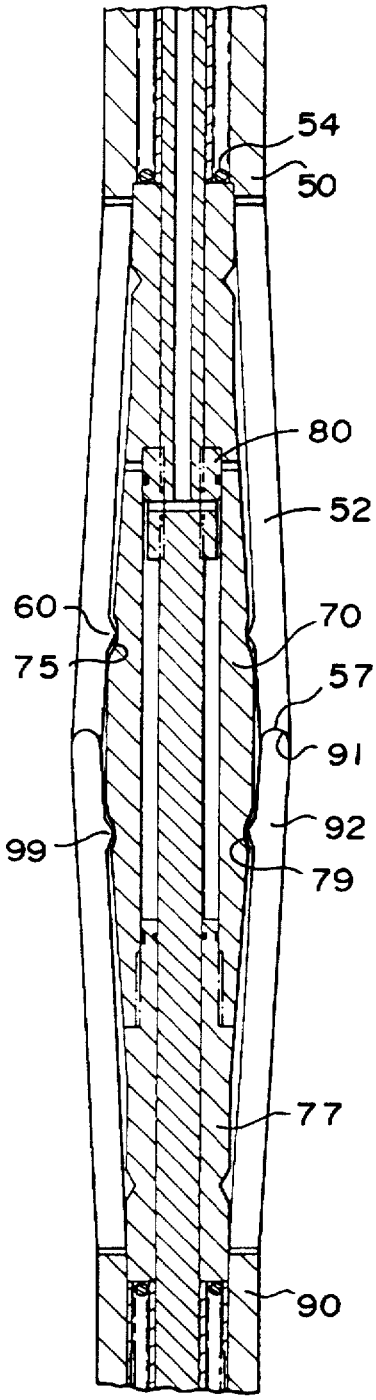

FIGS. 4A and 4B show relative positions of certain parts of the system 10 upon the application of working fluid under pressure. The force of the fluid has moved the upper piston housing 22 down with respect to the upper piston 20 and has moved the collet expander 70 down with respect to the lower piston 80 by applying sufficient force to move the fingers' male detents from the recesses 72, 78 respectively, along the exterior of the collet expander 70, and into the recesses 75, 79 respectively. The top curved finger portions 91 of the fingers 92 have moved into the recesses 57 of the fingers 52. The shear pins 13 have not yet been sheared and the cone 11 has not yet moved into the liner patch P. As the pistons are moving in the collet expander, the pistons of the setting tool are moving.

Figure 5:
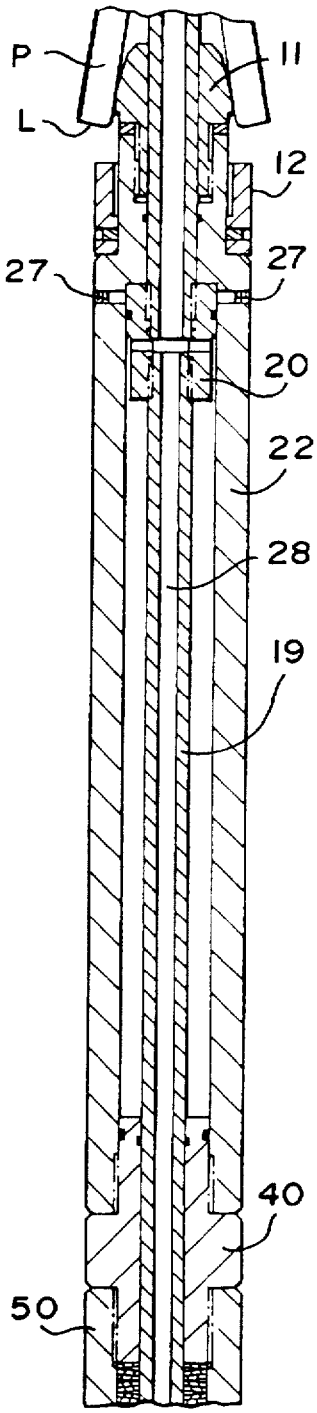

As shown in FIG. 5, an upward pull on the system 10 from the setting tool has sheared the shear pins 13 releasing the cone 11 and housing 22; and the cone 11 has commenced its entry into the liner patch P forcing it apart within the casing (not shown). As described above, the cone 11 has been prevented from entering the liner patch P until the collet fingers 52 and 92 have fully expanded over the collet expander 70. If the cone 11 were permitted to prematurely enter the liner patch P without full extension of the fingers 52, 92 the cone alone and/or the improperly expanded fingers may not adequately expand the liner patch P to achieve a good seal of a leak area.

The length of the extension rod 34 is related to the length of the liner patch P used. The length of the liner patch P also determines the length of additional rods (extension rods) connected to the setting tool. By using overlapping fingers 52 and 92 (see FIG. 3E) and with the top curved portions 91 resting in the corresponding recesses 57, no gap between finger ends of fingers 52 and 92 is presented to the liner patch P, pressure distribution from the fingers to the patch is uniform, and the patch is substantially all "ironed out" by the collet fingers.

In certain embodiments the major components of the system 10 are made of steel, e.g. 4140 steel. The polish rods may be made of 17-4PH stainless steel and the upper and lower collets may be made of 4145 steel. In other aspects the components are made of brass, bronze, aluminum, zinc, other suitable metals, or alloys or combinations thereof.

Once the collet expander and fingers have been pulled through the liner patch P, the circulation of working fluid is stopped, and the system is raised by pulling up on the working string. The hold down anchor apparatus is automatically released when fluid under pressure ceases to be pumped to the hold down anchor apparatus. The system is then raised a desired amount and the hold down is reset, working fluid is again circulated re-expanding the collet fingers, and the system 10 is again pulled further up through the liner patch P. This is done until the liner patch P has been expanded along its entire length. Once the system 10 is removed from the liner patch P, the anchoring hold down and the collets automatically contract so that the system 10 assumes its original diameter and is freed for removal from the wellbore. In a system with collet fingers about fourteen inches long as described above, about two feet of a liner patch P are expanded for an initial stroke of a setting tool. Each subsequent stroke expands about ten feet of the liner patch P.

In a typical operation of a system 10 to patch a casing in a wellbore, the system is run into a cased wellbore and may be run through an interior string, e.g. a tubing string, with a smaller inner diameter than that of casing which extends down below a lower end of the inner tubing string. Once the system exits the tubing string, it is moved to a location in the casing at which there is a hole or leak area to be patched. With the system properly located, working fluids are circulated down to the system at about 1000 p.s.i. to expand the collet fingers. Working fluid pressure is then increased to shear the cone shear pins, e.g. to about 1500 p.s.i. Then pressure is increased e.g. to 3500 p.s.i. to 5000 p.s.i. to pull the collet through the patch as the setting tool pulls the expanded collet assembly through the liner patch. Working fluid circulation is then stopped and the system is then pulled up on to re-set the setting tool to re-stroke hydraulic cylinders in the setting tool. Then the expansion cycle is repeated until complete liner patch expansion is achieved.

Figure 6A:
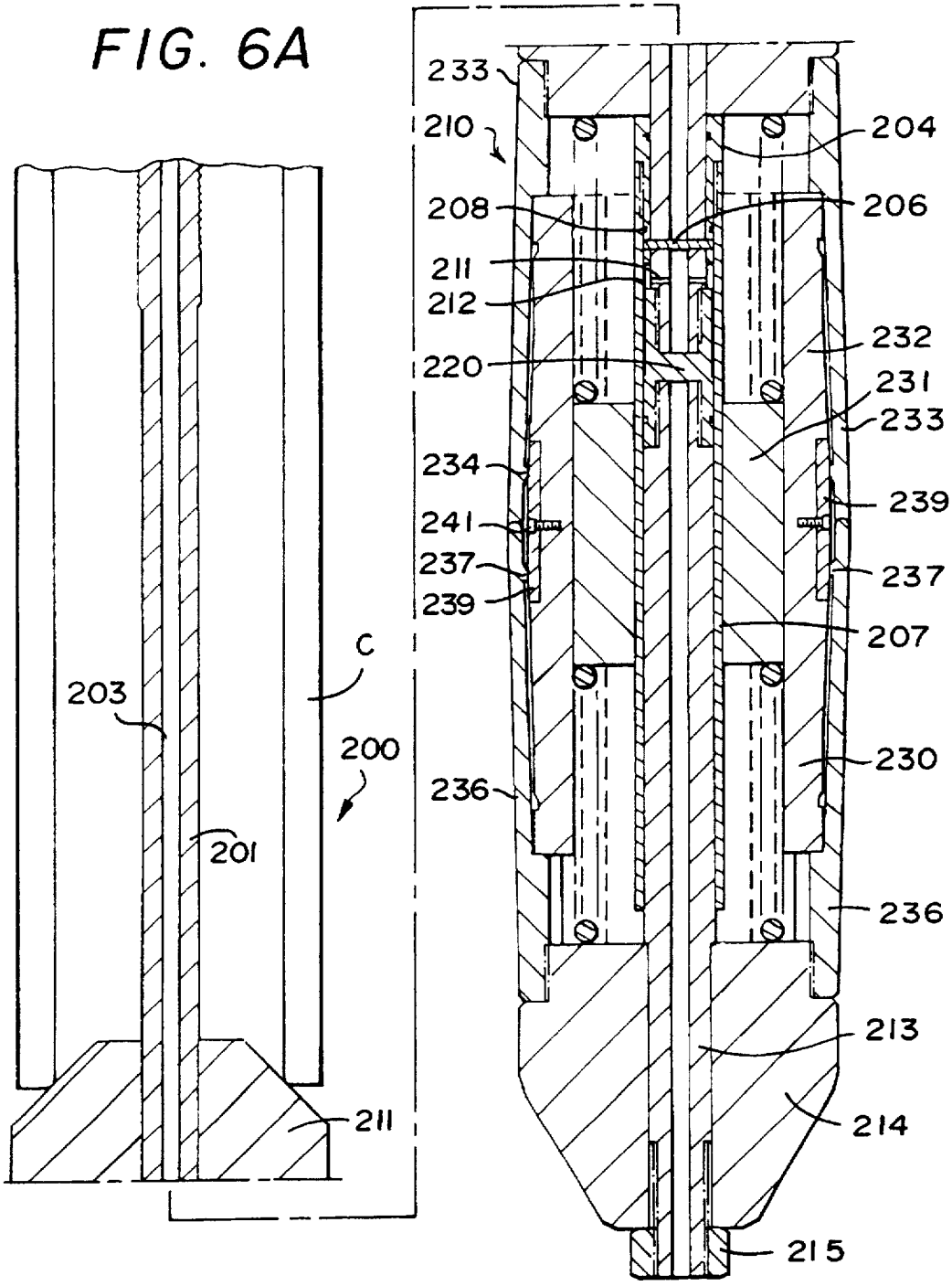
FIGS. 6A and 6B are side views in cross-section of a patch system according to the present invention.
Figure 6B:
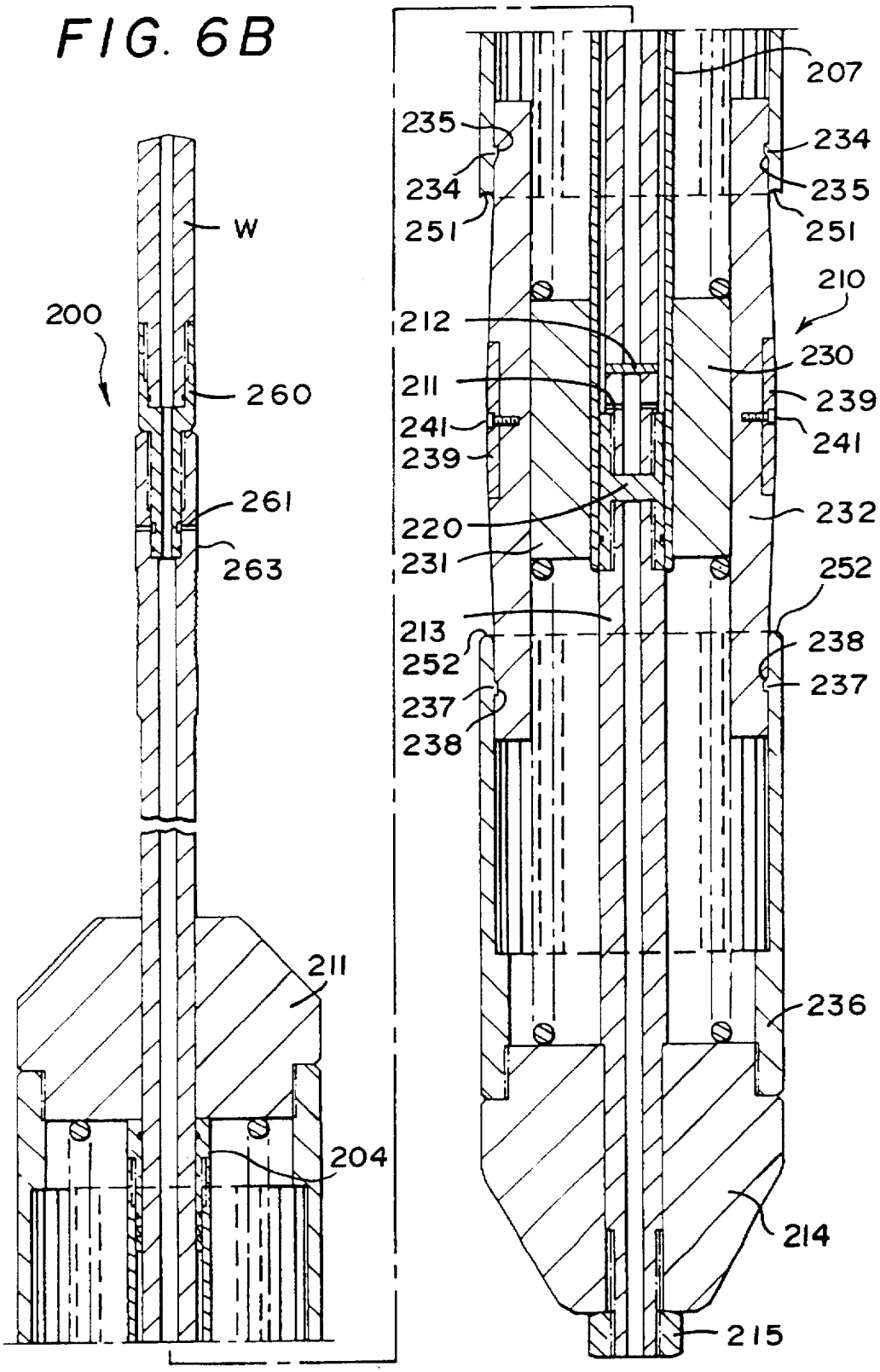

FIGS. 6A and 6B show a system 200 according to the present invention for expanding a liner patch C (shown partially in FIG. 6A) which may be any known liner patch of any suitable length, e.g. but not limited to a liner patch of length five feet, ten feet, twenty feet or more or a combination of a plurality of such liner patches in series end-to-end in a tubular, tubing, or casing). A connecting rod 201 extends to equipment and apparatuses above an expander assembly 210, the apparatuses and equipment like that described above for the system of FIG. 1A and for the system 10. A fluid flow channel 203 provides working fluid from the surface, through a work string or coiled tubing, to the system 200.

The connecting rod 201 extends through a cone 211, through an upper cylinder 204, and has a lower end threadedly connected to a piston 220. The connecting rod 201 is shear pinned (e.g. with a shear pin that shears in response to a 5000 p.s.i. force) by a shear pin 206 to the upper cylinder 204. The upper cylinder 204 is threadedly connected to a piston cylinder 207 and an O-ring seal 208 seals the upper-cylinder-204-piston-cylinder-207 interface.

Working fluid flows down through the fluid flow channel 203 and out through ports 211 into a space 212 above the piston 220.

A lower piston rod 213 has a top end threadedly connected to the piston 220 and a bottom end secured outside a cone 214 with a nut 215. A collet expander 230 is situated between the cones 211 and 214. The collect expander 230 has a middle portion 231 through which passes the piston cylinder 207. The piston cylinder 207 is movable with respect to the expander and the lower and upper rods. A body 232 surrounds and extends above and below the middle portion 231. Initially a series of upper collet fingers 233 threadedly connected to the cone 211 have their male detents 234 releasably positioned in corresponding female recesses 235 on the body 232 and a series of lower collet fingers 236 threadedly connected to the cone 214 have their male detents 237 releasably positioned in corresponding female recesses 238 on the body 232. In one aspect there are ten such fingers.

Adjusting plates 239 are removably secured by bolts 241 to the body 232. As shown in FIG. 6A the male detents 234 and 237 rest on the adjusting plates 239 when the system 200 is ready to enter the liner patch C. By using adjusting plates of different thickness, the extent to which the collet fingers 233 and 236 project out from the body 232 is adjustable. In one aspect a plurality (two, three, four or more) of interchangeable adjusting plates 239 is provided with the system 200 so that the system 200 may be used with casing having varying internal diameters. For example, and without limitation, casing with a nominal 20 inch outside diameter may have an inner diameter that varies up to 0.466 inches. The adjusting plates 239 may be in the form of two semi-circular half shells installable with bolts on the body 232.

The cones 211 and 214 are urged apart by a coil spring 243 disposed between the cone 211 and the middle portion 231 of the collet expander 230 and by a coil spring 244 disposed between the cone 214 and the middle portion 231 of the collet expander 230. In one aspect the springs have a spring force of about fourteen thousand pounds when the system is used to expand a liner patch in twenty inch casing.

As shown in FIG. 6A, the collet fingers 233 and 236 have expanded outwardly by pulling up on the connecting rod 201 with a setting tool (not shown; like those previously described) and the system 200 is ready to be pulled by the setting tool through the liner patch C which is disposed in a casing (not shown) having a hole or leak to be sealed off by the liner patch C.

In the event the collet fingers 233, 236 are not released from the position shown in FIG. 6A to return to an initial position in which the male detents 234, 237 are in the female recesses 235, 238 respectively, (e.g. the system 200 is caught and held in the liner patch C or, following exit from the liner patch C the collet fingers will not retract), working fluid is introduced under pressure through the connecting rod into the space 212 at sufficiently high pressure to shear the shear pin 206, thereby freeing the connecting rod 201 and the piston 220 for movement within the piston cylinder 207. The force of the working fluid pushes the cone 211 away from (up in FIG. 6B) the middle portion 231 of the collet expander 230 by pushing against the upper cylinder 204 and the piston 220. Thus the fingers 233, 236 are retracted and the removal of the system 200 is facilitated. Such a mechanism may be incorporated into the system of FIG. 2A.

A keyway-key or spline-groove arrangement may be used to connect the lower piston rod 213 and the cone 214 so the lower piston rod does not rotate with respect to the cone 214.

Preferably each finger 233 has a recess 251 which receives a part of an upper curved portion 252 of each finger 236 so that a smooth surface without finger end gaps is presented to a liner patch to be expanded.

As shown in FIG. 6B, the system 200 has exited the liner patch C and is ready to be removed from the wellbore in which the properly sealed casing is disposed. A safety joint 260 is interposed between a working string W and the system 200 in the event the system 200 needs to be "fished" from the wellbore. The safety joint 260 is shear pinned with a shear pin 261 to the connecting rod 201 (e.g. set to shear in response to torque). Upon shearing of the safety joint shear pin a fish neck 263 is exposed which is engageable by known fishing tools, e.g. an overshot tool.

As shown in FIG. 6B the collet fingers 233, 236 have been properly retracted and the system 200 has returned to its initial outer diameter which is suitable for movement up through the casing.

Figure 7A:
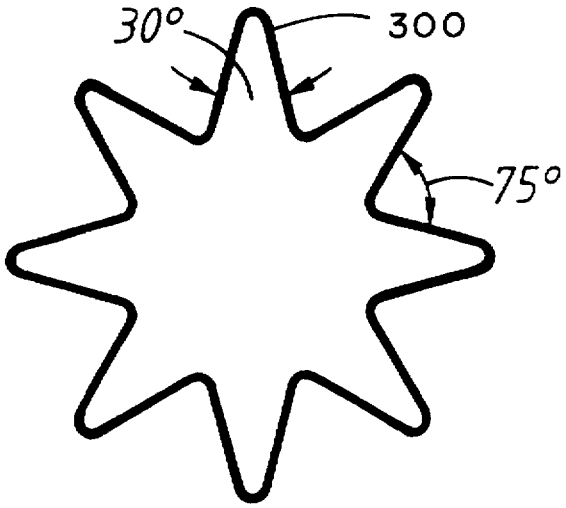
FIGS. 7A–7C are top views in cross-section of liner patches according to the present invention.
Figure 7B:
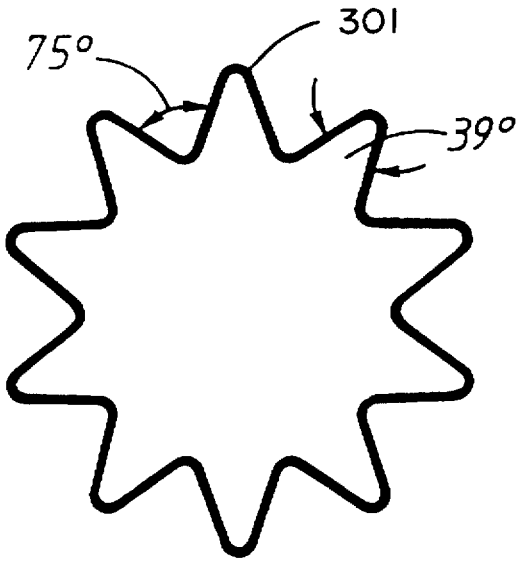
Figure 7C:
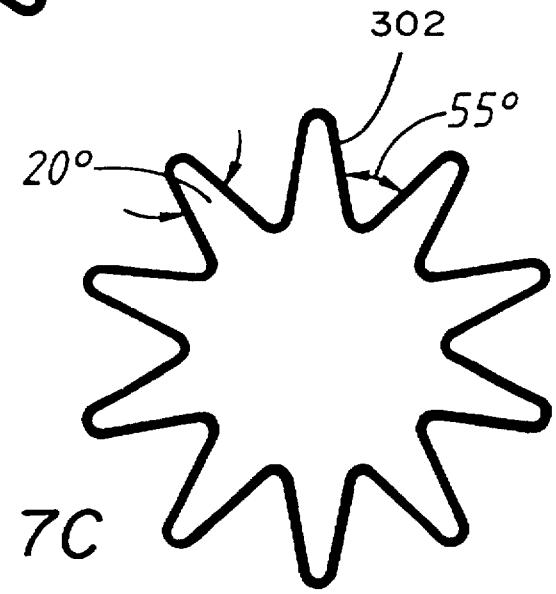

FIGS. 7A–7C show top cross-section views of liner patches according to the present invention (which may be any desired length). The materials used may be steel, stainless steel, zinc, brass, bronze, or any suitable metal or metal alloy of any desired thickness. In one aspect the liner patches of FIGS. 7A–7C are made of mild steel (e.g. 1018 steel) about 0.089 inches in wall thickness. They can vary in certain aspects from 0.065 inches to 0.1875 inches in wall thickness.

A liner patch 300 shown in FIG. 7A has 8 corrugations each with an angle of about 30° and at an angle of about 75° to each other. The liner patch 300 has an inner diameter of 2.125 inches, an outer diameter of 4.25 inches, and a circumference of about 6 inches. Such a liner patch is suitable for sealing a hole in six and five eights inch casing; but it is within the scope of this invention to size and configure the liner patch 300 for use with any casing or tubular.

A liner patch 301 shown in FIG. 7B has 10 corrugations each with an angle of about 39° and at an angle of about 75° to each other. The liner patch 301 has an inner diameter of 2.6019 inches, an outer diameter of 4.25 inches, and a circumference of about 6 inches. Such a liner patch is suitable for sealing a hole in six and five eights inch casing; but it is within the scope of this invention to size and configure the liner patch 301 for use with any casing or tubular.

A liner patch 302 shown in FIG. 7C has 10 corrugations each with an angle of about 20° and at an angle of about 55° to each other. The liner patch 302 has an inner diameter of 2.125 inches, an outer diameter of 4.25 inches, and a circumference of about 6 inches. Such a liner patch is suitable for sealing a hole in six and five eights inch casing; but it is within the scope of this invention to size and configure the liner patch 302 for use with any casing or tubular.

Figure 8A:
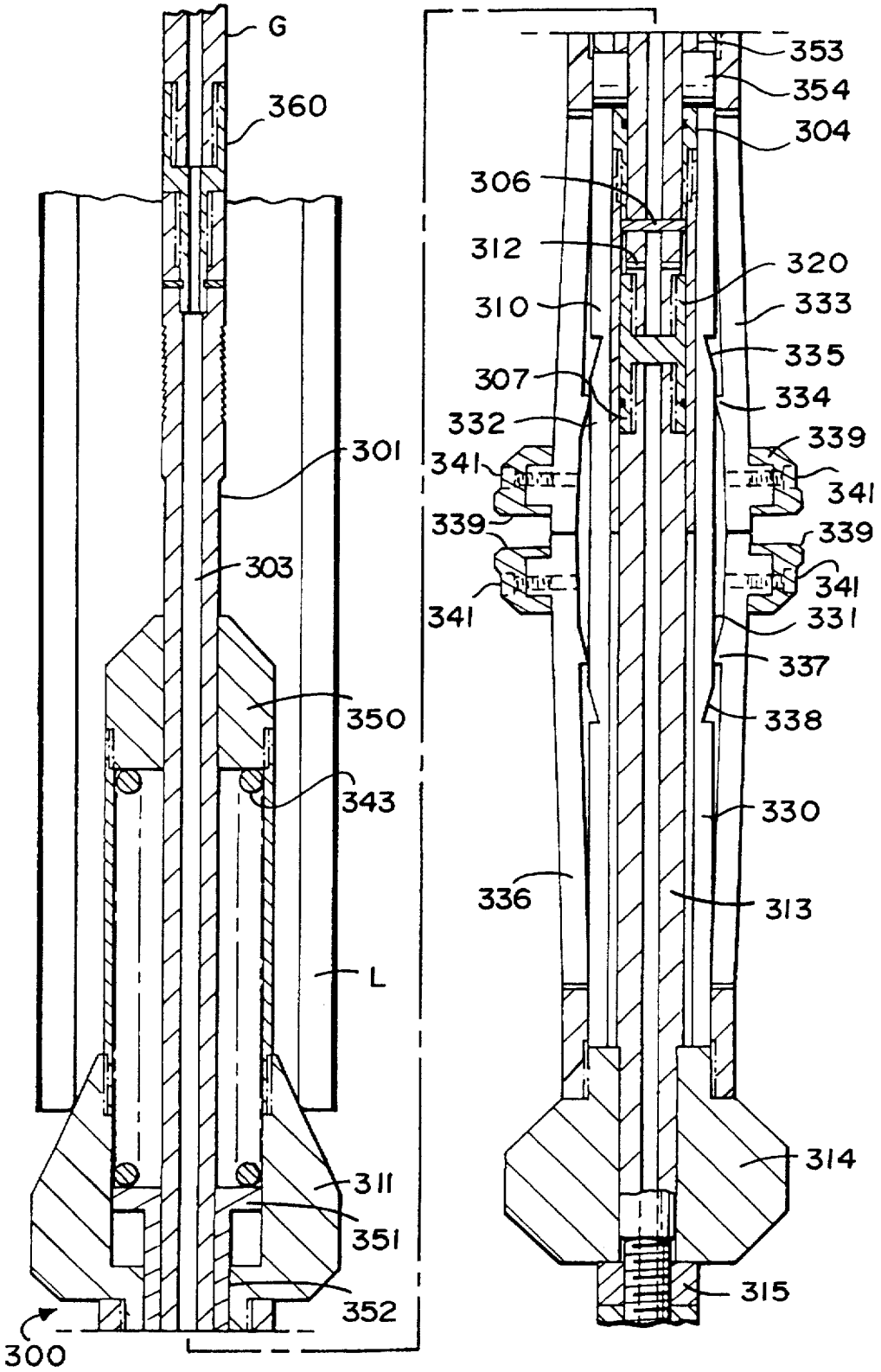
FIGS. 8A and 8B are side views in cross-section of a patch system according to the present invention.
Figure 8B:
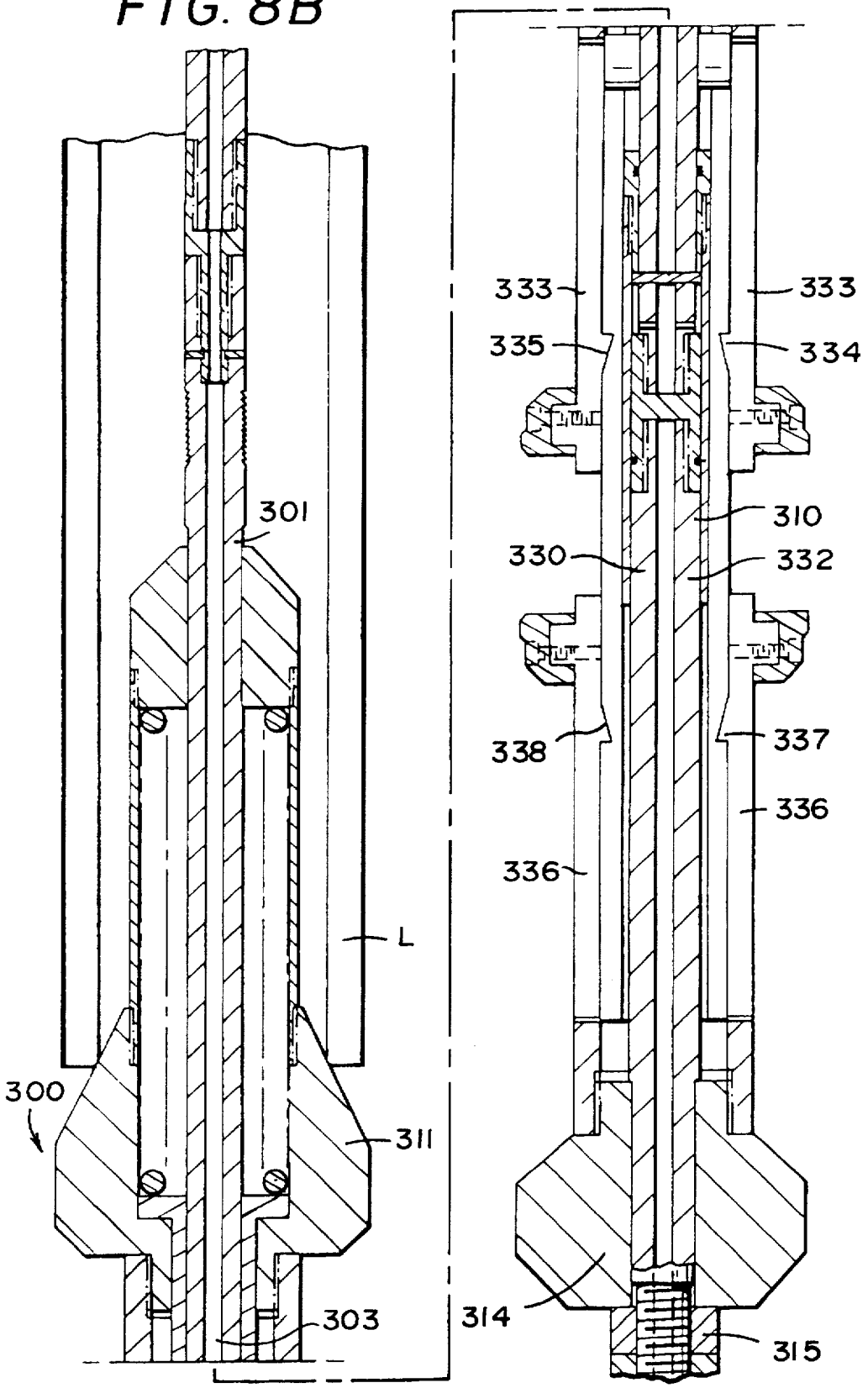

FIGS. 8A and 8B show a system 300 according to the present invention for expanding a liner patch L (shown partially in FIG. 8A) which may be any known liner patch of any suitable length, e.g. but not limited to a liner patch of length five feet, ten feet, twenty feet or more or a combination of a plurality of such liner patches in series end-to-end in a tubular, tubing, or casing). A connecting rod 301 extends to equipment and apparatuses above an expander assembly 310, the apparatuses and equipment like that described above for the system of FIG. 1A, the system 10, and the system 200. A fluid flow channel 303 provides working fluid from the surface, through a work string or coiled tubing, to the system 300.

The connecting rod 301 extends through a cone 311, through an upper cylinder 304, and has a lower end threadedly connected to a piston 320. The connecting rod 301 is shear pinned (e.g. with a shear pin that shears in response to a 5000 p.s.i. force) by a shear pin 306 to the upper cylinder 304. The upper cylinder 304 is threadedly connected to a piston cylinder 307.

Working fluid flows down through the fluid flow channel 303 and out through ports 312 into a space above the piston 320.

A lower piston rod 313 has a top end threadedly connected to the piston 320 and a bottom end secured outside a plug 314 with a nut 315. A collet expander 330 is situated between the cone 311 and the plug 314. The collect expander 330 has a middle portion 331 through which passes the piston cylinder 307. A body 332 surrounds and extends above and below the middle portion 331. Initially (see FIG. 8B) a series of upper collet fingers 333 have male detents 334 releasably positioned in corresponding female recesses 335 on the body 332 and a series of lower collet fingers 336 have male detents 337 releasably positioned in corresponding female recesses 338 on the body 332.

Adjusting pads 339 are removably secured by bolts 341 to the fingers 333 and 336. The pads 339 project from the fingers when the system 300 is ready to enter the liner patch L. By using adjusting pads of different thickness, the extent of projection out from the body 332 is adjustable to accommodate liner patches of different inner diameters. In one aspect a plurality (two, three, four or more) of adjusting pads 339 is provided with the system 300 so that the system 300 may be used with casing having varying internal diameters. For example, and without limitation, casing with a nominal 20 inch outside diameter may have an inner diameter that varies up to 0.466 inches.

The cone 311 is urged apart from an inner cone 350 by a coil spring 343 disposed between the cone 311 and a flange 351 of a sleeve 352 disposed around the rod 301. In one aspect the spring has a spring force of about twenty thousand pounds when the system is used to expand a liner patch in twenty inch casing. A lower end 353 of the sleeve 352 rests on a spacer 354 made of steel.

As shown in FIG. 8A, the collet fingers 333 and 336 have expanded outwardly by pulling up on the connecting rod 301 with the setting tool and the system 300 is ready to be pulled by the setting tool through the liner patch L which is disposed in a casing (not shown) having a hole or leak to be sealed off by the liner patch L.

In the event the collet fingers 333, 336 are not released from the position shown in FIG. 8A to return to an initial position in which the male detents 334, 337 are in the female recesses 335, 338 respectively, (e.g. the system 300 is caught and held in the liner patch L or, following exit from the liner patch L the collet fingers will not retract), working fluid is introduced under pressure into the space above the piston 320 at sufficiently high pressure to shear the shear pins 306, thereby freeing the connecting rod 301 and the piston 320 for movement within the piston cylinder 307. The force of the working fluid pushes the expander body 332 upwardly and the cone 311 upwardly (up in FIG. 8). Thus the fingers 333, 336 are retracted from their expanded position to their initial position (see FIG. 8B) and the removal of the system 300 is facilitated. Upon exit of the cone 311 and the fingers 333, 336 from the liner, the spring 343 forces the finger detents back into their recesses automatically.

A keyway-key or spline-groove arrangement may be used to connect the lower piston rod 313 and the cone 314 so the lower piston rod does not rotate with respect to the cone 314.

In one aspect each finger 333 has a recess which receives a part of an upper curved portion of each finger 336 so that a smooth surface without finger end gaps is presented to a liner patch to be expanded (as with the fingers 233, 236 described above).

A safety joint 360 is interposed between a working string G and the system 300 in the event the system 300 needs to be "fished" from the wellbore. The safety joint 360 is shear pinned to the connecting rod 301 (e.g. like the rod 201 and pin 261). Upon shearing of the safety joint shear pin a fish neck is exposed which is engageable by known fishing tools, e.g. an overshot tool.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. An expander system for passage through a liner patch to expand the liner patch to seal a hole in a tubular member, the tubular member part of a tubular string in a wellbore extending from a surface of the earth down into the earth, the expander system comprising a body having a top, a bottom, and a middle portion, the top having an outer diameter, the bottom having an outer diameter substantially equal to the outer diameter of the top, and the middle portion having an outer diameter greater than the outer diameter of the top, a first set of first fingers, each first finger movable and having a first finger top and a first finger bottom, the first finger bottoms disposed around the top of the body and releasably connected thereto, a second set of second fingers, each second finger movable and having a second finger top and a second finger bottom, the second finger tops disposed around the bottom of the body and releasably connected thereto, movement apparatus for releasing the first and second sets of fingers from the body and moving the fingers to abut the middle portion of the body so that the fingers project radially outwardly from the middle portion of the body for expanding the liner patch when pulled therethrough.

2. The expander system of claim 1 wherein each first finger has an inwardly directed male detent, the top of the body has a female recess corresponding to each male detent of a first finger, the middle portion of the body has a female recess corresponding to each male detent of a first finger, the male detents of the first fingers initially releasably held in the corresponding female recesses of the top of the body.

3. The expander system of claim 2 further comprising the first fingers movable outwardly by the movement apparatus to move the male detents of the first fingers out from the corresponding female recesses in the top of the body, and the first fingers then movable by the movement apparatus to move each male detent into a corresponding female recess on the middle portion of the body.

4. The expander system of claim 1 wherein each second finger has an inwardly directed male detent, the top of the body has a female recess corresponding to each male detent of a second finger, the middle portion of the body has a female recess corresponding to each male detent of a second finger, the male detents of the second fingers initially releasably held in the corresponding female recesses of the top of the body.

5. The expander system of claim 4 further comprising the second fingers movable outwardly by the movement apparatus to move the male detents of the second fingers out from the corresponding female recesses in the top of the body, and the second fingers then movable by the movement apparatus to move each male detent into a corresponding female recess on the middle portion of the body.

6. The expander system of claim 1 wherein each first finger bottom has a recess therein and each second finger top is shaped for receipt within an opposing first finger bottom, and the expander system further comprising the fingers movable by the movement apparatus so that at least a portion of each second finger top is movable into at least a portion of a corresponding opposing recess in an opposing first finger bottom.

7. The expander system of claim 6 wherein the first fingers are circumferentially offset with respect to the second fingers.

8. The expander system of claim 1 further comprising a housing having a top and having a bottom to which the first finger tops are secured, a nose cone secured to the top of the housing, the nose cone for facilitating entry of the expander system into the liner patch, a nose cone sleeve disposed about the nose cone for initially abutting a lower end of the liner patch to prevent entry of the nose cone into the liner patch, the nose cone sleeve releasably secured to the top of the housing by a shearable member which is selectively shearable by imposing a force on the housing sufficient to shear the shearable member thereby permitting entry of the nose cone into the liner patch.

9. The expander system of claim 8 further comprising a connecting rod movably extending through the nose cone and through the housing, the connecting rod connected to a working string extending through the wellbore to the earth surface, and a piston movably disposed within the housing and connected to the connecting rod so that pulling up on the connecting rod moves the piston to the top of the housing and then pulling up on the connecting rod with the working string applies force to shear the shearable member.

10. The expander system of claim 1 further comprising at least one adjusting member releasably secured to the body, the fingers movable over the at least one adjusting member so that the fingers project radially outward from the adjusting member for expanding the liner patch.

11. The expander system of claim 1 further comprising a plurality of adjusting members, one of the plurality of adjusting members releasably attached to each first finger bottom so that a portion of the adjusting members projects radially outward from the first finger bottoms.

12. The expander system of claim 1 further comprising a plurality of adjusting members, one of the plurality of adjusting members releasably attached to each second finger top so that a portion of the adjusting members projects radially outward from the second finger tops.

13. The expander system of claim 1 further comprising a plurality of adjusting members, one of the plurality of adjusting members releasably attached to alternating first finger bottoms and one of the plurality of adjusting members attached to alternating second finger tops, a portion of the adjusting members projecting radially outward from the fingers.

14. The expander system of claim 1 wherein the outer diameter of the middle portion is at least one inch greater than the outer diameter of the top of the body.

15. The expander system of claim 1 further comprising reset apparatus contacting the body for automatically moving the fingers away from the middle portion of the body upon exit of the expander system from the liner patch.

16. The expander system of claim 15 wherein the reset apparatus further comprising a first housing having a top, a bottom and bore therethrough from top to bottom, the first finger tops secured to the bottom of the first housing, an upper spring seat disposed across the bore of the first housing driving the first housing into an upper chamber and a lower chamber, a first spring in the lower chamber which urges the first housing away from the body, the first spring having a spring force which must be overcome by the movement apparatus to release the first fingers from the body.

17. The expander system of claim 1 further comprising a hollow connecting rod extending through the body, the connecting rod having a fluid flow channel therethrough, a lower housing to which the second finger bottoms are secured and through which extends and to which is secured to a lower end of the connecting rod, an upper housing to which the first finger tops are secured and through which movably extends a portion of the connecting rod, a shearable member releasably holding the connecting rod and initially preventing the connecting rod from moving with respect to the body, the connecting rod connected to a working string extending up to the earth surface through the wellbore, a piston cylinder disposed above the body, a portion of the connecting rod extending through the piston cylinder, a piston connected to the connecting rod and movable on said rod in the piston cylinder, the piston cylinder disposed so that fluid under pressure is selectively flowable thereinto to shear the shearable member forcing the upper and lower housings away from the body moving the fingers away from the middle portion of the body.

18. An expander system for passage through a liner patch to expand the liner patch to seal a hole in a tubular member, the tubular member part of a tubular string in a wellbore extending from a surface of the earth down into the earth, the expander system comprising a body having a top, a bottom, and a middle portion, the top having an outer diameter, the bottom having an outer diameter substantially equal to the outer diameter of the top, and the middle portion having an outer diameter greater than the outer diameter of the top, a first set of first fingers, each first finger movable and having a first finger top and a first finger bottom, the first finger bottoms disposed around the top of the body and releasably connected thereto, a second set of second fingers, each second finger movable and having a second finger top and a second finger bottom, the second finger tops disposed around the bottom of the body and releasably connected thereto, movement apparatus for releasing the first and second sets of fingers from the body and moving the fingers to abut the middle portion of the body so that the fingers project radially outwardly from the middle portion of the body, each first finger having an inwardly directed male detent, the top of the body having a female recess corresponding to each male detent of a first finger, the middle portion of the body having a female recess corresponding to each male detent of a first finger, the male detents of the first fingers initially releasably held in the corresponding female recesses of the top of the body, the first fingers movable outwardly by the movement apparatus to move the male detents of the first fingers out from the corresponding female recesses in the top of the body, and the first fingers then movable by the movement apparatus to move each male detent into a corresponding female recess on the middle portion of the body, each second finger having an inwardly directed male detent, the top of the body having a female recess corresponding to each male detent of a second finger, the middle portion of the body having a female recess corresponding to each male detent of a second finger, the male detents of the second fingers initially releasably held in the corresponding female recesses of the top of the body, the second fingers movable outwardly by the movement apparatus to move the male detents of the second fingers out from the corresponding female recesses in the top of the body, and the second fingers then movable by the movement apparatus to move each male detent into a corresponding female recess on the middle portion of the body, each first finger bottom having a recess therein and each second finger top shaped for receipt within an opposing first finger bottom, the expander system further comprising the fingers movable by the movement apparatus so that at least a portion of each second finger top is movable into at least a portion of a corresponding opposing recess in an opposing first finger bottom, and the first fingers circumferentially offset with respect to the second fingers.

19. An expander system for passage through a liner patch to expand the liner patch to seal a hole in a tubular member, the tubular member part of a tubular string in a wellbore extending from a surface of the earth down into the earth, the expander system comprising a body having a top, a bottom, and a middle portion, the top having an outer diameter, the bottom having an outer diameter substantially equal to the outer diameter of the top, and the middle portion having an outer diameter greater than the outer diameter of the top, p1 a first set of first fingers, each first finger movable and having a first finger top and a first finger bottom, the first finger bottoms disposed around the top of the body and releasably connected thereto, a second set of second fingers, each second finger movable and having a second finger top and a second finger bottom, the second finger tops disposed around the bottom of the body and releasably connected thereto, movement apparatus for releasing the first and second sets of fingers from the body and moving the fingers to abut the middle portion of the body so that the fingers project radially outwardly from the middle portion of the body, a housing having a top and having a bottom to which the first finger tops are secured, a nose cone secured to the top of the housing, the nose cone for facilitating entry of the expander system into the liner patch, a nose cone sleeve disposed about the nose cone for initially abutting a lower end of the liner patch to prevent entry of the nose cone into the liner patch, the nose cone sleeve releasably secured to the top of the housing by a shearable member which is selectively shearable by imposing a force on the housing sufficient to shear the shearable member thereby permitting entry of the nose cone into the liner patch, a connecting rod movably extending through the nose cone and through the housing, the connecting rod connected to a working string extending through the wellbore to the earth surface, a piston movably disposed within the housing and connected to the connecting rod so that pulling up on the connecting rod with the working string moves the piston to the top of the housing and then pulling up on the connecting rod with the working string applies force to shear the shearable member, and reset apparatus contacting the body for automatically moving the fingers away from the middle portion of the body upon exit of the expander system from the liner patch.

20. An expander system for passage through a liner patch to expand the liner patch to seal a hole in a tubular member, the tubular member part of a tubular string in a wellbore extending from a surface of the earth down into the earth, the expander system comprising a body having a top, a bottom, and a middle portion, the top having an outer diameter, the bottom having an outer diameter substantially equal to the outer diameter of the top, and the middle portion having an outer diameter greater than the outer diameter of the top, at least one set of fingers, each finger movable and having a two ends one of which is disposed around the body and releasably connected thereto, movement apparatus for releasing the finger ends releasably connected to the body and for moving said ends to abut the middle portion of the body so that the fingers project radially outwardly from the middle portion of the body for expanding the liner patch when pulled therethrough.

* * * * *

UNITED STATES PATENT AND TRADEMARK OFFICE

CERTIFICATE OF CORRRECTION

PATENT NO. : 5,785,120
DATED : July 28, 1998
INVENTOR(S) : Smalley et al.

It is certified that error appears in the above-identified patent and that said Letters Patent is hereby corrected as shown below:

On the title page, add the following to item [56]:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 3 | 6 | 2 | 7 | 0 | 6 | 8 | 12/71 | Wagnon et al | | | |
| | | 3 | 2 | 9 | 7 | 0 | 9 | 2 | 1/67 | Jennings | | | |
| | | | | | | | | | | | | | |

UNITED STATES PATENT AND TRADEMARK OFFICE

CERTIFICATE OF CORRRECTION

PATENT NO. : 5,785,120 
DATED : July 28, 1998
INVENTOR(S) : Smalley et al.

It is certified that error appears in the above-identified patent and that said Letters Patent is hereby corrected as shown below:

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 2 | 2 | 7 | 6 | 6 | 48 | A | GB | | | | | |
| | | 7 | 9 | 0 | 4 | 5 | 5 | | GB | | | | | |
| | | PCT | /GB | 96 | /0 | 29 | 0 | 3 | PCT | | | | | |
| | | | | | | | | | | | | | | |

UNITED STATES PATENT AND TRADEMARK OFFICE

CERTIFICATE OF CORRRECTION

PATENT NO. : 5,785,120 Page 3 of 3
DATED : July 28, 1998
INVENTOR(S) : Smalley et al.

It is certified that error appears in the above-identified patent and that said Letters Patent is hereby corrected as shown below:

OTHER DOCUMENTS

| | | |
|---|---|---|
| | | "Patches Cure Leaky Casing Problems In Indonesia," Smith, Oil & Gas Journal, May 28, 1990 |
| | | Communication Realting to The Results Of The Partial Int'l Search, PCT/GB97/03049 |
| | | (counterpart of this case S.N. 08/748,987) |

Signed and Sealed this

Sixth Day of April, 1999

*Attest:*

*Attesting Officer*

Q. TODD DICKINSON

*Acting Commissioner of Patents and Trademarks*